US007847753B2

(12) United States Patent
Ishibashi et al.

(10) Patent No.: US 7,847,753 B2
(45) Date of Patent: Dec. 7, 2010

(54) TRANSPARENT ANTENNA FOR DISPLAY, TRANSLUCENT MEMBER FOR DISPLAY WITH AN ANTENNA AND HOUSING COMPONENT WITH AN ANTENNA

(75) Inventors: Tatsuo Ishibashi, Kyoto (JP); Shuzo Okumura, Kyoto (JP); Yuki Matsui, Kyoto (JP); Yoshitaka Yamaoka, Kyoto (JP); Takayuki Takagi, Kyoto (JP); Hiromitsu Muko, Kyoto (JP); Ryomei Omote, Kyoto (JP)

(73) Assignee: Nissha Printing Co., Ltd., Kyoto (JP)

( * ) Notice: Subject to any disclaimer, the term of this patent is extended or adjusted under 35 U.S.C. 154(b) by 461 days.

(21) Appl. No.: 11/887,579

(22) PCT Filed: Mar. 31, 2006

(86) PCT No.: PCT/JP2006/306957

§ 371 (c)(1),
(2), (4) Date: Oct. 1, 2007

(87) PCT Pub. No.: WO2006/106982

PCT Pub. Date: Oct. 12, 2006

(65) Prior Publication Data

US 2009/0051620 A1 Feb. 26, 2009

(30) Foreign Application Priority Data

| | | |
|---|---|---|
| Apr. 1, 2005 | (JP) | 2005-106529 |
| Apr. 25, 2005 | (JP) | 2005-126895 |
| Apr. 25, 2005 | (JP) | 2005-127219 |
| May 27, 2005 | (JP) | 2005-155120 |
| Jun. 1, 2005 | (JP) | 2005-162002 |

(51) Int. Cl.
*H01Q 1/36* (2006.01)

(52) U.S. Cl. ..... 343/897; 343/702

(58) Field of Classification Search ..... 343/702, 343/700 MS, 872, 895, 897
See application file for complete search history.

(56) References Cited

U.S. PATENT DOCUMENTS 6,268,832 B1 * 7/2001 Twort et al. ..... 343/713

(Continued)

FOREIGN PATENT DOCUMENTS

EP 0911906 A2 4/1999

(Continued)

OTHER PUBLICATIONS

Supplementary European Search Report issued Jul. 14, 2009 in connection with counterpart European Patent Application No. 06730905.

(Continued)

*Primary Examiner*—HoangAnh T Le
(74) *Attorney, Agent, or Firm*—Wenderoth, Lind & Ponack, L.L.P.

(57) ABSTRACT

A transparent antenna for a display, for example, a portable telephone, the transparent antenna performing good transmission and reception, not bulky, and not impairing design of an apparatus. The transparent antenna for a display has an insulating sheet-like transparent substrate and has a planar antenna pattern formed on the surface of the transparent substrate. An electrically conductive section of the antenna pattern is constructed from an electrically conductive thin film of a mesh structure, outlines of each mesh are constituted from extra fine bands with substantially the same width, and the light transmittance of the section where the antenna pattern is formed is equal to or more than 70%.

33 Claims, 28 Drawing Sheets

U.S. PATENT DOCUMENTS

| | | | | |
|---|---|---|---|---|
| 6,384,790 | B2 | 5/2002 | Dishart et al. | |
| 6,538,620 | B2 * | 3/2003 | Lin | 343/895 |
| 6,862,002 | B2 * | 3/2005 | Demicco et al. | 343/846 |
| 7,423,596 | B2 * | 9/2008 | Maniwa et al. | 343/700 MS |

FOREIGN PATENT DOCUMENTS

| | | |
|---|---|---|
| EP | 2004/027923 | 4/2004 |
| EP | 1 508 938 | 2/2005 |
| JP | 64-49302 | 2/1989 |
| JP | 2-256304 | 10/1990 |
| JP | 3-39911 | 4/1991 |
| JP | 2000-124730 | 4/2000 |
| JP | 2000-138512 | 5/2000 |
| JP | 2000-341020 | 12/2000 |
| JP | 2001-196826 | 7/2001 |
| JP | 2001-274611 | 10/2001 |
| JP | 2002-518920 | 6/2002 |
| JP | 2003-090903 | 3/2003 |
| JP | 2003-258483 | 9/2003 |
| JP | 2004-207880 | 7/2004 |
| JP | 2004-356823 | 12/2004 |
| JP | 2005-64174 | 3/2005 |
| JP | 2005-142984 | 6/2005 |
| WO | 2004/027923 | 4/2004 |
| WO | 2004/084346 | 9/2004 |

OTHER PUBLICATIONS

International Search Report issued May 16, 2006 in the International (PCT) Application of which the present application is the U.S. National Stage.

Informal Comments filed Jul. 7, 2006 in the International Application PCT/JP2006/306957, of which the present application is the U.S. National Stage.

International Preliminary Report on Patentability issued Oct. 3, 2007 in the International (PCT) Application of which the present application is the U.S. National Stage.

European Search Report issued Apr. 15, 2010 in corresponding European Application No. 06 730 905.4.

European Office Action issued Apr. 15, 2010 in corresponding European Application No. 06 730 905.4.

* cited by examiner the attaching object side

TRANSPARENT ANTENNA FOR DISPLAY, TRANSLUCENT MEMBER FOR DISPLAY WITH AN ANTENNA AND HOUSING COMPONENT WITH AN ANTENNA

BACKGROUND OF THE INVENTION

I. Technical Field

The present invention relates to a transparent antenna for a display, a translucent member for a display with an antenna and a housing component with an antenna composed so as to receive terrestrial broadcasting and satellite broadcasting or to transmit and receive radio which are attached to a display screen of a television monitor, a mobile terminal such as a cellular phone handset or built in a housing of a cellular phone handset as a part thereof.

II. Description of the Related Art

In recent years, various broadcastings such as terrestrial digital broadcasting have been provided, and transmission and reception of wireless LAN and transmission and reception via an external network are becoming common. In such a situation, there is a trend of an increasing demand for a miniaturized antenna.

As an indoor antenna for television, a loop antenna, a rod antenna and the like have been conventionally known, and these antennas are placed near a television to be connected to the television via an antenna cable.

On the other hand, as an antenna for mobile devices such as mobile phone and the like, a rod-shaped miniaturized antenna protruded from a body of the mobile phone is commonly used (For example, refer to Japanese Unexamined Patent Application Publication No. 2004-207880).

However, the loop antenna and the rod antenna are bulky and are not good in terms of appearance and design, and are inconvenient in carrying.

With respect to an antenna for mobile devices, receiver sensitivity is not always satisfactory since the antenna is stored inside a limited space.

Further, in recent years, an antenna for mobile devices is required to respond to various communication frequencies such as television, radio broadcasting, GPS (global positioning system), RFID (radio frequency identification), and Bluetooth in addition to having functions of telephone, internet communication and the like, so a plurality of antennas are required. In attaching these antennas in one mobile device, the space allocated to one antenna is becoming even smaller.

The present invention is in view of the above circumstances. A main object of the present invention is to provide a transparent antenna for a display, a translucent member for a display with an antenna and a housing component with an antenna which is capable of good transmission and reception which is not bulky and does not damage the design of the device.

SUMMARY OF THE INVENTION a. Transparent Antenna for a Display

A transparent antenna for a display according to the present invention comprises a sheet-like transparent substrate having an electrical isolation, an antenna pattern formed on a surface of the transparent substrate in planar form, characterized in that an electrically conductive part of the antenna pattern comprises an electrically conductive thin film of a mesh structure, outlines of each mesh comprise extra fine bands having substantially equal width and that a light transmittance of the antenna pattern formation section is 70% or more.

The transparent antenna for a display of the present invention is composed so as to be attached planarily on a display screen of a television, a mobile phone and the like. Particularly, with respect to miniaturized mobile devices such as a mobile phone, even though a body size thereof is small, since a proportion of the display is relatively large compared to a body size thereof, an antenna is attached by effectively utilizing an area of the display. Namely, a front surface of the display which has not been conventionally regarded as an antenna-setting space is used as an antenna-setting space.

By a transparent antenna for a display of the present invention, since an electrically conductive part constituting the antenna pattern is formed into a mesh structure having a multitude of apertures, and outlines of each mesh are composed of extra fine bands, there is an advantage that the antenna pattern is recognized only as a slight variation of shading when looking at the display screen through the transparent antenna for a display.

Since a relatively large area on the display can be used as an antenna-setting space, receiver sensitivity can be enhanced and good transmission and reception is possible.

Additionally, even when a plurality of antennas are attached on a mobile device, since a relatively large front surface of the display can be used as described above, so that a positioning of an antenna is possible without damaging the design. In the transparent antenna for a display, a light transmittance is more preferably 80% or more.

It is also possible to attach a transparent electrically conductive film such as ITO (indium tin oxide) as an antenna on a front surface of the display, but the transparent electrically conductive film has a property that as a film thickness thereof becomes thinner and a degree of transparency becomes higher, surface resistance thereof as an indicator of electrical conductivity becomes larger. Therefore, there is a situation that it is difficult to obtain low resistivity required for an antenna while securing transparency. While resistivity of a transparent electrically conductive film with transparency secured has a resistivity of a few dozen to a few hundreds Ω, a resistance value required for an antenna must be very small, as small as 3Ω or less.

On the other hand, a mesh structure which is an assembly of extra fine bands of the present invention can achieve low resistivity which is required for an antenna while securing transparency.

A subject-matter of the present invention is that the antenna pattern is set in a mesh shape, a mesh pitch and a bias angle which do not form a moire pattern with a mesh pattern which forms a picture element of the display.

In the present invention, a distinguish pattern can be distinguished from the antenna pattern if the mesh structure comprises a plane mesh in which a mesh having the same shape and size continues regularly on a plane surface, and in a part of the antenna pattern, the distinguishing pattern is added to an inner part of a plurality of the meshes in a linear form, or to outlines of a plurality of the meshes in a band-like form, since an amount of light that passes through those meshes becomes less than an amount of light that passes through the antenna pattern.

The distinguishing pattern can be formed by using thicker bands for the outline of the mesh constituting the plane mesh. Also, it can be formed by shifting a part of the mesh pattern of the mesh structure on the antenna pattern within a range that does not exceed the size of one mesh and overlapping it on the antenna pattern. If such a distinguishing pattern is formed continuously or intermittently on the antenna pattern, a letter and a design can be formed on the transparent antenna surface.

In the present invention, the mesh structure is constituted of a plane mesh regularly continuing on a plane surface and a gradation section to reduce brightness difference formed between an antenna pattern and an antenna pattern non-formation section can be provided on a border region between the antenna pattern and the antenna pattern non-formation section of a transparent substrate.

The gradation section can be formed by omitting a part of the outline of the mesh of the antenna pattern in the border region or by roughening the mesh.

The gradation section can be formed by making the omitted width of the outline or a width of the aperture of the mesh longer gradually from the side of the antenna pattern toward the side of the antenna pattern non-formation section.

The gradation section can be formed by positioning a vertical direction electrically conductive wire and a transverse direction electrically conductive wire in a lattice like state to constitute a mesh structure and omitting a part of those, at least either vertical direction electrically conductive wire or transverse direction electrically conductive wire, or by enlarging spacing between the electrically conductive wires from a side of the antenna pattern toward a side of the antenna pattern non-formation section.

In the present invention, the antenna pattern can be formed into a continuous band-like state by having a slit in a part of the mesh structure. However, it is to be within a range that the width of the slit does not exceed a maximum size of the mesh size.

The antenna pattern can be formed in a meandering shape, in order to elongate the effective length of the antenna, by forming a plurality of slits in a predetermined length alternatively from different directions in a mesh structure. Further, the antenna pattern can be formed by forming one slit in a spiral form toward the center of the mesh structure. A maximum size of the mesh is preferably to be 1 mm.

In the transparent antenna for a display, a shape of the meshes may be constituted of geometric designs.

However, in the case where the lines of the meshes do not form geometric designs of extra fine bands, for example, in a case where a large number of circular holes are formed on a sheet face, even if the circular holes are arranged at the maximum density, wide width parts are formed between neighboring circular holes and not only the wide width portion is made outstandingly visible but also the light transmittance is decreased. Accordingly, the present invention excludes those of geometric designs in which the lines of the meshes are not constructed from extra fine bands even if the antenna pattern has a geometric design such as circles and ellipses.

The width of the each of the extra fine bands is preferably 30 μm or less, since if the width of each of the extra fine bands is thin, the presence of the extra fine bands is hard to recognize.

Additionally, the antenna pattern can be composed of extra fine metal wires made of copper or a copper alloy.

Further, a transparent protection film is preferably formed on a surface of the antenna pattern, since a damage of the antenna pattern can be prevented by the transparent protection film.

In this case, a preferred constitution is that a part of the electrically conductive part is equipped with an electrode for power supply and a transparent protection film corresponding to the electrode is provided with a through hole part to expose the electrode.

Further, a surface of the extra fine bands is preferably subjected to low reflection treatment. Even if a material of the extra fine bands gives off a metallic luster, the low reflection treatment reduces the luster so that it becomes inconspicuous.

Additionally, a transparent adhesive layer can be formed on a face of opposite the electrically conductive part forming side of the transparent substrate. In this manner, the transparent antenna for a display of the present invention will be easily attached afterwards on a front surface of the display.

b. Translucent Member for a Display having an Antenna

A feature of the translucent member for a display with an antenna of the present invention is that a transparent antenna for a display equipped with electrodes for power supply in a part of the electrically conductive part is interposed between two pieces of translucent plate material for a display in a state in which the electrodes are projected. The translucent plate material for the display includes a plate material made of transparent synthetic resin such as a protection panel generally used for an outermost surface of the display, and, in addition, it may also be a glass.

The translucent member for a display with an antenna of the present invention can be obtained, for example, by making a protection panel for a display composed of a two layer structure and embedding a transparent antenna in the bonding face of the two protection panels during the process of manufacturing.

By the translucent member for a display with an antenna, a step equivalent to a thickness of the transparent antenna is not formed on a surface of the display just as in a case where an antenna is attached afterwards, so that design can be further improved. Additionally, a stable antenna performance can be ensured by embedding the antenna between translucent members for display with an antenna.

In the translucent member for a display, the transparent antenna for a display and the translucent plate material for a display are integrated by injection molding. In this way, unity of the transparent antenna for a display and the translucent plate material for a display will be improved.

If the transparent antenna for a display and the translucent member for a display with an antenna described above are used, since a display screen can be used effectively as an antenna setting space, it will be unnecessary to secure an antenna-setting space separately, and particularly when applied to a mobile device, miniaturization thereof will be possible.

Further, even when placed on a front surface of the display, a good display condition can be obtained without lowering visibility. Further, it does not damage design of the device, not bulky, and offer a good antenna performance. Additionally, it will be possible to mount a plurality of antennas without damaging design of the device, so it is effective for miniaturizing the device as well as enhancing performance of the device.

c. Housing Component with an Antenna

A feature of the housing component with an antenna of the present invention is that a housing component comprises a molded resin material as a main constituting layer and has an opaque decorative part in a part or an entire part thereof, and a front surface side of a layer giving a decoration of the opaque decorative part has an antenna pattern in a planar form having a light transmittance of 70% or more, and an electrically conductive part of the antenna pattern is composed of an electrically conductive thin film of a mesh structure, and outlines of each mesh are composed of extra fine bands having substantially an equal width, and it is equipped with an electrode for power supply for the antenna pattern.

A feature of another housing component with an antenna of the present invention is that a housing component having an antenna comprises a molded resin material as a main constituting layer, and a transparent decorative part in a part or an entire part thereof with which a decorative effect can be obtained by illumination from a back side, and the transparent decorative part has an antenna pattern in a planar form having a light transmittance of 70% or more , and the electrically conductive part of the antenna pattern is composed of an electrically conductive thin film of a mesh structure, and outlines of each mesh are composed of extra fine bands having substantially an equal width, and it is equipped with an electrode for power supply for the antenna pattern.

A feature of still another housing component with an antenna of the present invention is that the housing component with an antenna comprises a molded resin material as a main constituting layer and a transparent decorative part giving a decorative effect by illumination from a side surface in a part or an entire part thereof, and a front surface side of the molded resin material of the transparent decorative part has an antenna pattern in a planar form having a light transmittance of 70% or more, and an electrically conductive part of the antenna pattern is composed of an electrically conductive thin film of a mesh structure, and outlines of each mesh are composed of extra fine bands having substantially an equal width, and is equipped with an electrode for power supply for the antenna pattern.

In the housing component with an antenna, if the housing component with an antenna has a transparent window part for a display other than the decorative part, the antenna pattern can be extended up to the transparent window part. In this case, the housing component with an antenna includes a transparent window part and a window cover consisting only of a window frame section thereof.

If the antenna pattern is extended up to the transparent window part as described above, a relatively large area of the front surface of the display can be used when a plurality of antennas are mounted to the device, so that the antennas can be mounted without damaging design.

The housing component with an antenna can also function as a window cover.

The antenna pattern extended up to the transparent window part is preferably set in a mesh shape, a mesh pitch, and a bias angle which do not form a moire pattern with a mesh pattern that forms pixels of the display.

A part of the electrically conductive part of the antenna pattern can be used as the electrode for power supply.

In accordance with the housing component with an antenna, an electrically conductive part of the antenna pattern is formed into a mesh structure having a number of apertures, and since outlines of each mesh are composed of extra fine bands, when looking at an opaque decorative section and an illumination-decoration section where a decorative effect can be obtained by illumination, the antenna pattern is recognized only as a slight variation of shading, so that a design provided on the housing is not damaged by the attached antenna. Further, a front surface of a relatively large display can be used for a space for mounting the antenna so that receiver sensitivity can be improved and good transmission and reception are made possible. The light transmittance is preferably 80% or more.

DETAILED DESCRIPTION OF THE INVENTION

Figure 1:
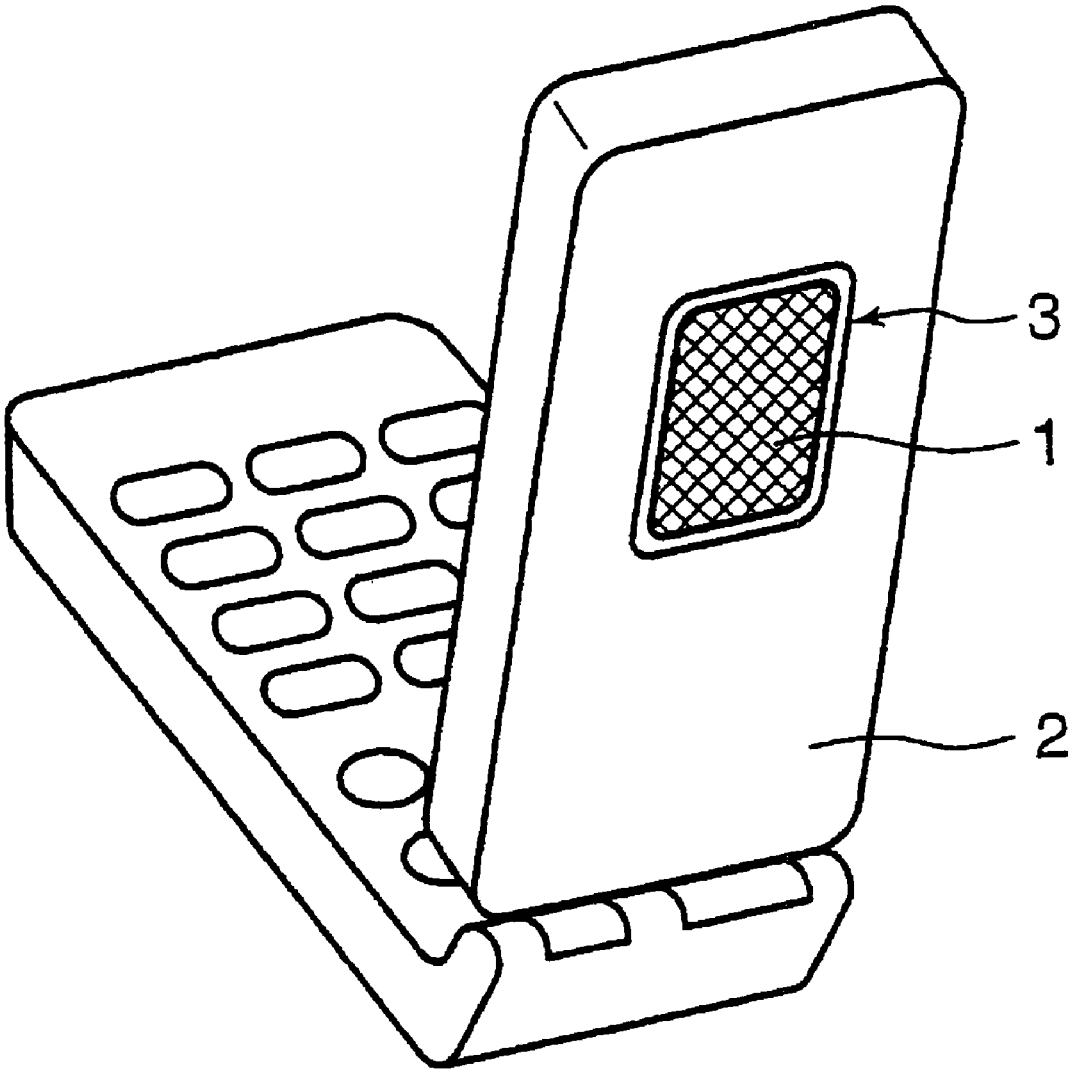
FIG. 1 is an explanatory drawing showing a transparent antenna for a display according to a first embodiment of the present invention.

Hereinafter, the present invention will be explained in detail based on embodiments shown in the drawings.

a-1. First Embodiment of the Transparent Antenna for a Display

FIG. 1 is a schematic diagram showing a state in which the transparent antenna for a display (hereinafter abbreviated as transparent antenna) 1 according to a first embodiment of the present invention is attached to a display screen 3 of a cellular phone handset 2.

The cellular phone handset 2 is a two-folded type handset equipped with a display screen (sub window) 3 on an outer surface when it is folded. A transparent antenna 1 is attached on an entire display area of the display screen 3.

An electrode for power supply of the transparent antenna 1 is connected to a transmission and reception section in the cellular phone handset 2 via an input-output terminal disposed on an outer frame of the display screen 3.

Figure 2:
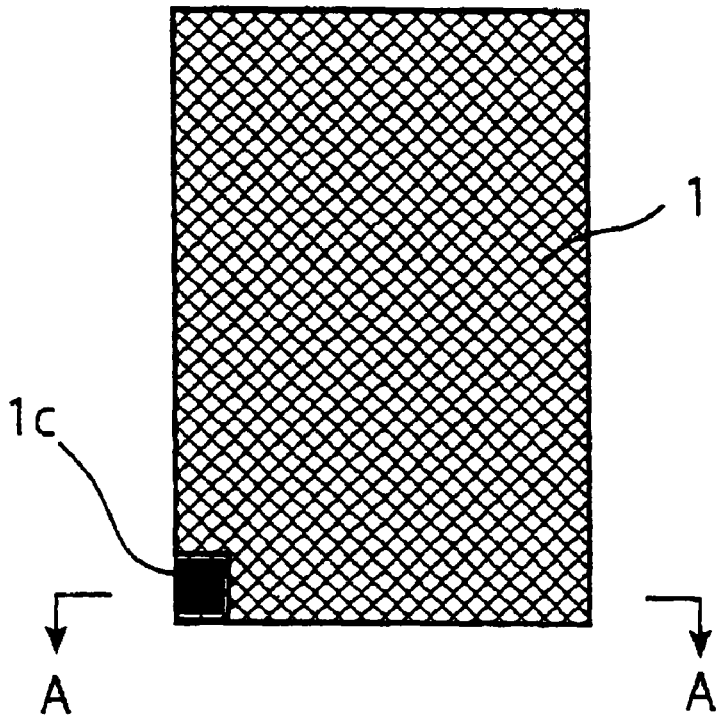
FIG. 2 is an enlarged view of a transparent antenna for a display shown in FIG. 1.

In FIG. 2, the transparent antenna 1 having an antenna pattern by an electrically conductive part 1*b* is formed on a transparent plastic sheet 1*a* as a transparent substrate having an electrical isolation. An outer shape of the transparent antenna 1 is a rectangular shape substantially corresponding to a size of the display screen 12.

As the transparent plastic sheet 1*a*, a transparent resin film or a plate material such as polycarbonate, an acrylic resin, polyethylene terephthalate and triacetyl cellulose may be used. As a transparent substrate, a sheet-like transparent glass may also be used.

The electrically conductive part 1*b* comprises an electrically conductive thin film of a mesh structure, and a metal thin film of copper, nickel, aluminum, gold, silver and the like or an electrically conductive resin paste film containing metallic particulates or carbon particulates of those may be used.

It is formed into a fine mesh-shaped pattern by photo-etching of an electrically conductive thin film formed on the transparent plastic sheet 1*a*, by an etching method using a print resist, and further by a method printing an electrically conductive resin paste or the like.

The electrode part 1*c* is provided to come in contact with the input-output terminal disposed on an outer frame of the display screen 3 of the cellular phone handset 2, and the electrode part 1*c* is formed in a square-shaped sheet electrically connected to the electrically conductive part 1*b*.

In case the antenna pattern is formed by photo-etching, a photoresist film is formed on a metal thin film or an electrically conductive resin paste film (hereinafter, these are occasionally referred to as metal thin film for convenience of explanation) to be subjected to exposure by photomask and development using a liquid developer, thereby forming an antenna pattern of a resist film.

It is subjected to etching by an etchant and the resist film is separated and removed so as to form an antenna pattern containing an extra fine metal wire (including an extra fine electrically conductive resin wire formed of an electrically conductive resin paste film; hereinafter the same).

When the antenna pattern is formed by etching of print resist, the antenna pattern of the resist film is printed on the metal thin film by a method such as screen printing, gravure printing, and ink-jet printing, and the metal thin film except for a resist-covered section is subjected to etching using an etchant, followed by separation of resist film, thereby forming the antenna pattern of the metal thin film.

In case the antenna pattern is formed by printing of an electrically conductive resin paste, the antenna pattern is printed on a transparent substrate material using an electrically conductive resin paste and a carbon resin paste and the like containing metal particulates, thereby forming an electrical conductive antenna pattern. Printing methods used herein include screen printing, gravure printing, ink-jet printing and the like, the same as described above.

Also, a surface of the extra fine bands formed on the mesh-shaped pattern is subjected to low reflection treatment, reflected colors of the metal and the like are suppressed so that the presence of the transparent antenna 1 becomes inconspicuous. In this way, visibility when looking at the display screen 3 through a mesh-shaped pattern is enhanced. Additionally, it can be expected that a contrast in the display screen 3 is increased and an image quality is improved.

Specific examples of the low reflection treatment include a surface treatment such as a chemical conversion treatment and plating. The chemical conversion treatment is a treatment wherein a low-reflection layer is formed on a surface of a metal by oxidation treatment or sulfurization treatment, and for example, if copper is used for a material of the extra fine metal wire, and an oxide film is formed on a surface thereof by oxidation, the surface of the extra fine metal wire can be treated so as to be in black color having an antireflection quality without reducing a section size of the extra fine metal wire.

As plating, for example, if the extra fine metal wire is subjected to black chromium plating, a surface of the extra fine metal wire can be treated to be colored black having an antireflection quality. If it is subjected to copper plating with high current density, it can be treated to be colored brownish-red.

Figure 3:
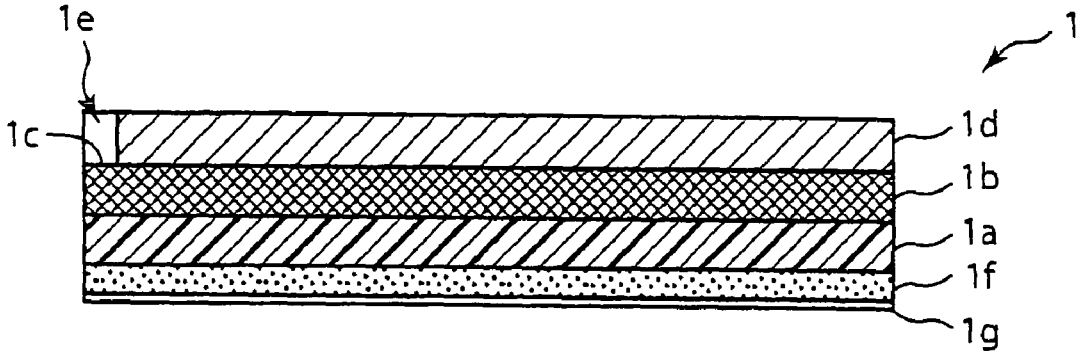
FIG. 3 is a cross sectional view as viewed from the direction of arrow A-A shown in FIG. 2.

As shown in FIG. 3, the electrically conductive part 1*b* is formed on the transparent plastic sheet (transparent base) 1*a*, and the electrically conductive part 1*b* is covered with a transparent cover layer (transparent protection film) 1*d*.

When the transparent antenna 1 is attached on a front surface of the display screen 3, an under surface side of the transparent antenna 1 may be attached facing the display screen 3, or an upper surface side of the transparent antenna 1 may also be attached facing the display screen 3.

Also the upper surface side of the transparent antenna 1 is attached facing the display screen 3, since the transparent plastic sheet (transparent substrate) 1*a* functions for protecting the electrically conductive part 1*b* just like the transparent cover layer 1*d*, the transparent cover layer 1*d* may be omitted.

In such a case, a transparent adhesive layer 1*f* may be provided on a surface of the electrically conductive part 1*b*

On the other hand, if the under surface side of the transparent antenna 1 is attached facing the display screen 3, the transparent cover layer 1*d* protects the electrically conductive part 1*b*, so that a stable antenna performance can be maintained even if the surrounding environment of the cellular phone handset 2 to which the transparent antenna 1 is attached, such as temperature and humidity, changes. Additionally, the antenna pattern is less susceptible to scratches due to existence of the transparent cover layer 1*d*.

As a method for forming the transparent cover layer 1*d*, for example, it can be formed by attaching the transparent film on an antenna pattern comprising the electrically conductive part 1*b* using a transparent adhesive or a pressure sensitive adhesive, and also by applying a transparent resin on the antenna pattern in a predetermined thickness.

A through hole part 1*e* is provided in a part of the transparent cover layer 1*d*, and an electrode part 1*c* is exposed through the through hole part 1*e*. The input-output terminal and the antenna wire provided on the outer frame of the display screen 3 are connected to the electrode part 1*c* which is exposed.

A transparent adhesive layer 1*f* is attached on an opposite surface of the electrically conductive part 1*b* of the transparent plastic sheet 1*a*, and a separating sheet 1*g* is attached on a surface of the transparent adhesive layer 1*f*. As the transparent adhesive layer 1*f*, one that does not damage transparency of an antenna such as a transparent acrylic adhesive and the like may be used.

When the transparent antenna 1 is attached on a display screen of the cellular phone handset 2 in the later process, the separating sheet 1*g* is separated to expose the transparent adhesive layer 1*f*, and the transparent antenna 1 is attached on a front surface of the display screen 3 via the transparent adhesive layer 1*f*.

The transparent antenna 1 having the above structure may be attached on a front surface of various displays including the television monitor screen, display screen of a personal computer and the like in addition to the display screen 3 of the cellular phone handset 2.

b. Translucent Member for a Display

On the other hand, when a translucent member for a display having an antenna is composed using the transparent antenna 1, the transparent antenna 1 is interposed between two pieces of translucent plate material for a display. Examples of the translucent plate material for a display include a plate material made from a transparent synthetic resin such as a transparent acrylic plate and a transparent polycarbonate plate.

In the present invention, the translucent member denotes a member having light transparency which is substantially transparent.

When the transparent antenna 1 is embedded between the translucent plate material pieces, the transparent antenna 1 is integrated with two translucent plate material pieces, so that the transparent adhesive layer if is not indispensable. The transparent cover layer 1*d* may be formed as required. Just as the above description that the through hole part le is provided in the transparent cover layer 1*d*, a through hole part is provided in a position which is a part of the translucent plate material for a display and corresponds to the through hole part 1*e* so that the electrode part 1*c* is exposed through the through hole part. The input-output terminal and the antenna wire attached to the outer frame of the display screen 3 are connected to the electrode part 1*c*.

Further, in case a resin is used as a raw material for the translucent plate material for a display, injection molding may be employed, so that a molten resin is discharged in a paste and the transparent antenna 1 is interposed between the discharged resin. When the molten resin is hardened, the transparent antenna 1 is interposed between two pieces of the translucent plate material for a display to be integrated.

In this way the transparent antenna 1 is inserted by injection molding, a translucent plate material for a display having a three-dimensional curve may also be easily formed. Accordingly, it can be attached when the display screen 3 is in a shape of having a three-dimensional curve.

Additionally, a material with high hardness is used as a material for the translucent plate material for a display, the transparent antenna 1 may be used instead of a conventional display protection panel. Also, a translucent plate material for a display which has been subjected to low reflection treatment is used, visibility of a display items on the display screen 3 can be enhanced.

Continuously, a transparent antenna for a display will be explained.

Figure 4:
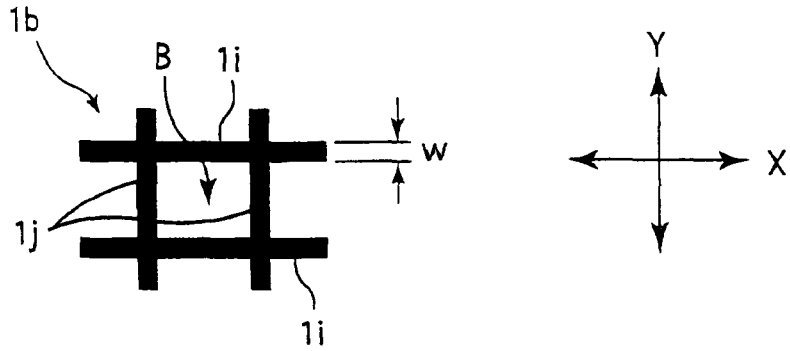
FIG. 4 is an enlarged view of a relevant part showing a basic pattern of an extra fine metal wire constituting the electrically conductive part of FIG. 2.
Figure 5:
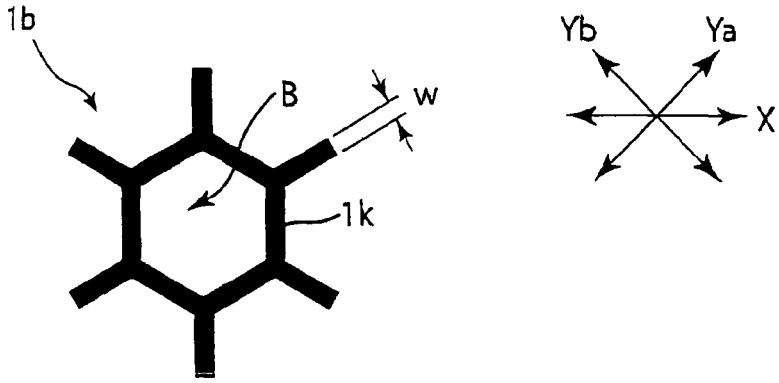
FIG. 5 shows a variation of the antenna pattern corresponding to FIG. 4.
Figure 6:
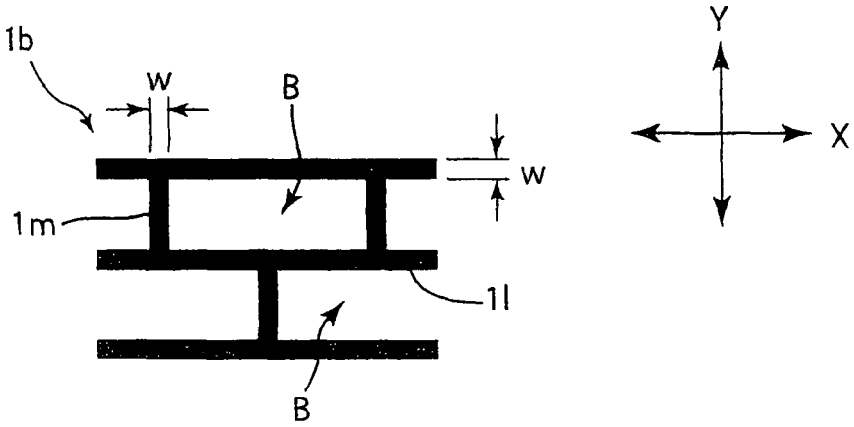
FIG. 6 shows another variation of the antenna pattern corresponding to FIG. 4.

FIGS. 4 to 6 show an enlarged view of a part of the antenna pattern of the transparent antenna.

The antenna pattern shown in FIG. 4 is formed into a lattice-shaped mesh, having a linear shaped electrically conductive part 1*b* extended in X direction and Y direction wherein a light transmittance in the transparent antenna 1 is ensured to be 70% or more.

The above-mentioned light transmittance which is a gauge of the transparency means the total light transmittance with respect to the total amount of light having the entire wavelength emitted from a light source having a specific color temperature which has been transmitted through a surface of a specimen. If the light transmittance becomes lower than 70%, an image of the display viewed through the transparent antenna 1 becomes darker, damaging image quality thereof. On the other hand, if the transmission is excessively enhanced, a preferable antenna performance (such as surface resistance value) cannot be obtained; thus, this point should be taken into consideration in setting the transmittance.

The above-mentioned light transmittance is measured using a spectrometer manufactured by Nippon Denshoku Industries Co., Ltd. (Model number NDH2000). However, 100% of the light transmittance in an air layer is defined as the standard.

In the case where the transparent cover layer 1*d* is formed on the transparent antenna 1, the light transmittance is measured in a state that the transparent cover layer 1*d* is included, and in the case where the transparent pressure adhesive layer 1*f* is provided, the light transmittance is measured in a state that the transparent pressure adhesive layer if is included.

Further, the wire widths w of the extra fine metal wire (extra fine band) 1*i* which shapes an outline of a square in the X direction and an extra fine metal wire (extra fine band) 1*j* in the Y direction are formed into an equal width of 30 μm or less, respectively. If each of the wire widths w becomes thicker than 30 μm, a mesh of the antenna pattern becomes outstandingly visible, and the design quality thereof becomes poor. Furthermore, it becomes an obstacle for viewing an image in the display.

If the wire width w becomes 30 μm or less, a presence of the antenna pattern is hard to recognize so that display becomes easily viewable. With respect to a film thickness of the extra fine metal wire, if an aspect ratio of the wire width/film thickness t becomes 0.5 or more, an antenna pattern having a high accuracy can be easily made.

In the present embodiment, a light transmittance of the transparent antenna 1 is ensured to be 70% or more by selecting combinations of the wire width of the extra fine metal wire 1*i* and 1*j* and a size of an aperture part B formed by being surrounded by these extra fine metal wires 1*i* and 1*j*.

An antenna pattern shown in FIG. 5 is made to be a mesh-like shape having a hexagonal shape as a core and continuous in the X-direction, the Ya-direction and the Yb-direction.

The wire width w of the extra fine metal wire 1*k* forming the outlines of the hexagon is 30 μm or less.

The antenna pattern shown in FIG. 6 is made to be a mesh-like shape having a ladder shape as a core and continuous in the X-direction and the Y-direction. The wire widths w of the extra fine metal wires 1*l* and 1*m* forming the outlines of the ladder shape are 30 μm or less, respectively.

As described, the antenna pattern may include those having continuous rectangular shapes as a core, those having continuous polygonal shapes as a core, and those having continuous ladder shapes as a core.

Further, in order to prevent the transparent antenna for a display from forming a moire pattern with a mesh pattern which forms a picture element of the display, a mesh shape of the transparent antenna pattern, a mesh pitch, and a bias angle are adjusted according to the size and shape of the picture element of the display. In practice, a convenient and easy method is to make several kinds of trial products and check the existence or nonexistence of the moire pattern by visual observation to determine a specification.

Among them, those having continuous square shapes as a core are particularly preferable since it becomes hard to recognize the antenna pattern as stripes as compared with other polygonal shapes.

Herein, the moire pattern denotes a thick fringe streak which is visible when mesh-shaped patterns are overlapped due to the intervention of an upper and lower mesh.

That is, when a pattern regularly continuing a certain shape as a core is seen, the lines tends to be seen in continuous stripes along the continuing cores (apertures). For example, in the case where a hexagonal shape forms the core, the lines of the above-mentioned extra fine bands along the continuous directions become zigzag and accordingly the lines seem to be thick to the extent corresponding to the fluctuation of the zigzag shape and as a result, the extra fine bands are seen in an expanded state. On the other hand, in the case of those having the above-mentioned square shapes as a core, since the lines of the extra fine bands along the continuous directions become straight, there is no probability that the lines are seen to be thicker than the actual width and as described above, the extra fine bands are so extremely thin, i.e., 30 μm or thinner, and thus the existence is hardly recognized and the antenna pattern is not seen outstandingly.

In the case of those having continuous rectangular shapes as a core, since the pitches in the longer side direction and the shorter side direction of the rectangular shape differ, and therefore, if the entire body is observed, the lines are seen to be darker in the shorter side direction in which the pitches are shorter than in the longer side direction and they tend to be seen just like stripes, meanwhile in the case of those having the above-mentioned square shapes as a core, such stripes do not appear and are not seen outstandingly.

The above-mentioned square shapes may include not only complete squares having stiff corners but also chamfered squares.

Example 1

Hereinafter, the present invention will be described in more detail with reference to Examples, but the present invention is not restricted by the following Examples and can be suitably modified within the scope described above or below and such modifications are also included in the technical scope of the present invention.

On a transparent polyethylene terephthalate film (transparent substrate 1*a*) with a thickness of 100 μm, a transparent resin layer containing a plating catalyst was formed to be subjected to electroless copper nickel plating, followed by electrolytic copper plating, thereby forming a metal thin film.

Next, both surfaces of the metal thin film were subjected to chemical conversion treatment(low reflection treatment). Then, an aperture was formed by photo-etching method on the metal thin film (to be an electrically conductive thin film of the mesh structure) to give an antenna pattern.

The electrically conductive part 1*b* of this antenna pattern is a square mesh pattern shown by FIG. 4, and the extra fine band 1*i* thereof has a line width (w) of 15 μm, line space pitches of 400 μm, and a bias angle of 30°.

Next, a transparent polyethylene terephthalate cover film (transparent cover layer (transparent protection film) 1*d*) subjected to low reflection treatment with a thickness of 125 μm was bonded on the electrically conductive part 1*b* of the antenna pattern using an acryl-based transparent adhesive. However, the electrode part 1*c* was exposed from an opening (through hole part 1*e*) formed by cutting a part of the cover film.

A both side coated transparent acrylic type pressure sensitive adhesive film (transparent adhesive layer 1*f*) with a separating sheet for attaching the transparent antenna 1 on a display screen of a device was attached on an opposite side surface (backside) of the electrically conductive part 1*b* of the transparent polyethylene terephthalate film (transparent substrate 1*a*).

In this manner, an antenna pattern was formed on the transparent polyethylene terephthalate film, and was further covered with a cover film, and a laminated layer body in which the both side coated transparent acrylic type pressure sensitive adhesive film having a separating sheet was put on the backside of the transparent polyethylene terephthalate film was obtained; the outside of the laminated layer body was cut along the antenna pattern to produce the transparent antenna 1.

Light transmission of the transparent antenna 1 thus produced was 82%.

A separating sheet 1*g* of the transparent antenna 1 was removed, and was attached on a screen of the liquid crystal display, and an antenna code was connected to the electrode part 1*c* which is exposed, and the antenna code was connected to a receiving part of a main unit of the liquid crystal display.

For TV reception, a good receiving condition was obtained. With respect to the transparent antenna 1, the presence of the antenna pattern could not be substantially recognized, so that a clear image could be seen.

Example 2

A copper foil with a thickness of 12 μm having both surfaces with lowered reflectance by chemical conversion treatment was bonded on a transparent polycarbonate film (transparent substrate 1*a*) having a thickness of 100 μm using a transparent adhesive, and subsequently an antenna pattern of a resist film was printed; after a copper foil except for a resist-covered section was subjected to etching using an etchant, the resist film was removed, thereby forming the antenna pattern. The antenna pattern has an electrically conductive part 1*b* in which a shape of a mesh aperture thereof is a regular hexagonal lattice pattern, 500 μm on a side, and a line width of a extra fine band 1*k* (refer to FIG. 5) was 25 μm.

Then, along the antenna pattern thus prepared, the outside thereof was cut to give a transparent antenna 1. The transparent antenna 1 was inserted in a metal mold for a sub window protection panel of a cellular phone handset to feed a polycarbonate resin in the metal mold and carry out injection molding. By this process, sub window parts for a cellular phone handset (translucent member for a display having an antenna) in which a translucent plate material layer made from polycarbonate was positioned on front and back sides of the transparent antenna 1 was obtained. However, in the injection molding, a structure in which an electrode part 1*c* was protruded from a surrounding of the translucent plate material was formed.

A light transmittance of the resultant sub window parts having an antenna was 73%.

Sub window parts having an antenna were disposed on a sub window of the cellular phone handset, and an electrode part 1*c* was connected to an input-output terminal mounted on an outer frame of the sub window.

When the cellular phone handset was operated, a presence of an antenna pattern of the transparent antenna 1 could not substantially be recognized, so a clear display image could be seen. The receiving condition of radio waves was also good.

a-2. Second Embodiment of Transparent Antenna for Display

A transparent antenna of the second embodiment is enabled to have letters and designs on an antenna pattern.

Figure 7:
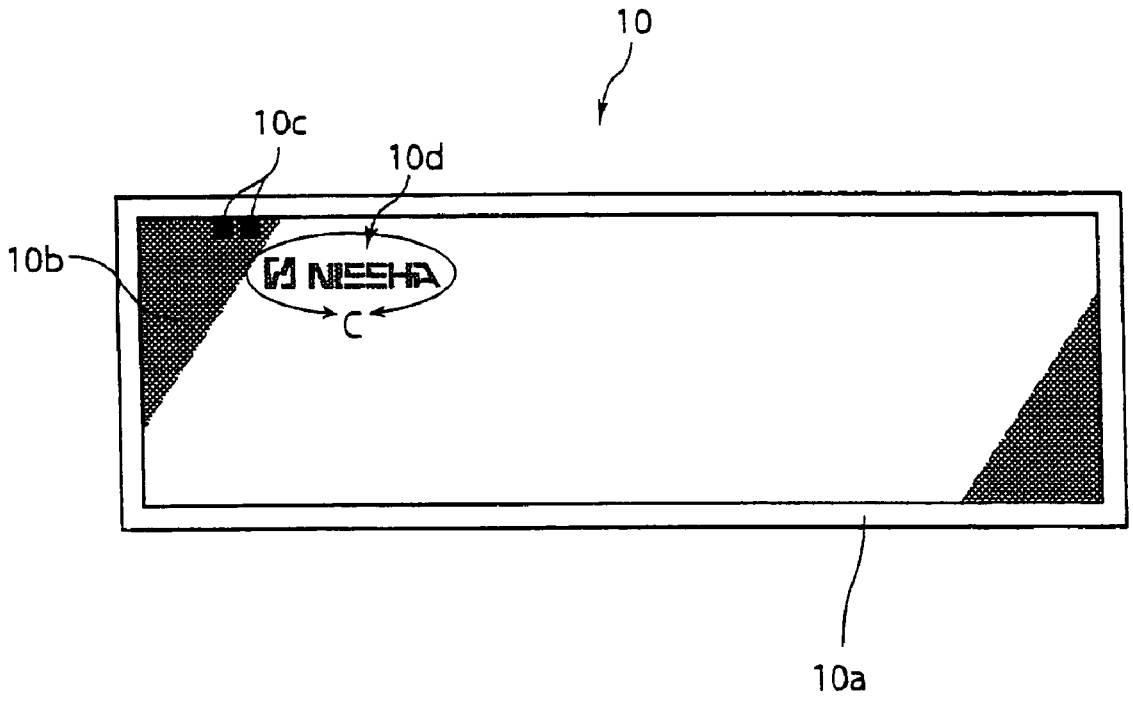
FIG. 7 is an enlarged view showing a second embodiment of the transparent antenna for a display.

A transparent antenna 10 shown in FIG. 7 comprises an antenna pattern as a electrically conductive section 10*b* planarly formed on a transparent plastic sheet 10*a* as an electrically insulating transparent base body and an antenna terminal 10*c* is formed in the left upper part of the antenna pattern formed transversely long rectangular shape.

Reference symbol 10*d* shows logo designed on the transparent antenna 10 and the formation method of the logo will be described later.

The above-mentioned transparent plastic sheet 10*a* is made of the same material as that of the transparent plastic sheet 1*a* shown in FIG. 3 and the above-mentioned electrically conductive section 10*b* is also made of the same material as that of the electrically conductive section 1*b* and has the same configuration.

The above-mentioned antenna terminal 10*c* is for sticking the electric power supply section (not shown) of the antenna cord 4 and the antenna terminal 10*c* is constructed from a square sheet electrically connected with the mesh-like pattern.

Figure 8:
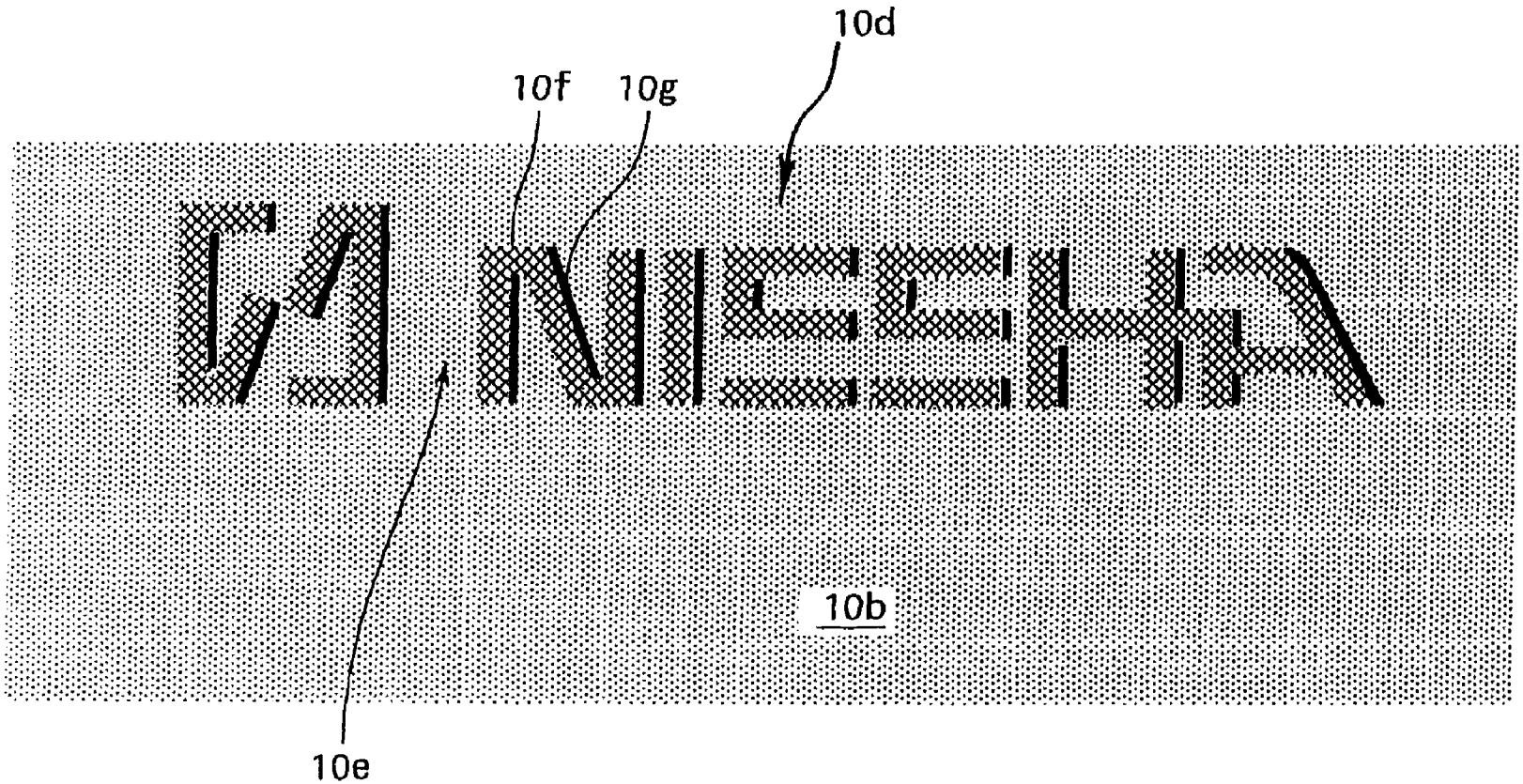
FIG. 8 is an enlarged view of section C in FIG. 7.

FIG. 8 is an enlarged view of a C part in FIG. 7.

The logo 10*d* was formed on the mesh section 10*e* constructed from the electrically conductive section 10*b* and constructed by combining a letter section 10*f* and a letter shadow section 10*g* showing the shadow of the letter section 10*f*.

Figure 9:
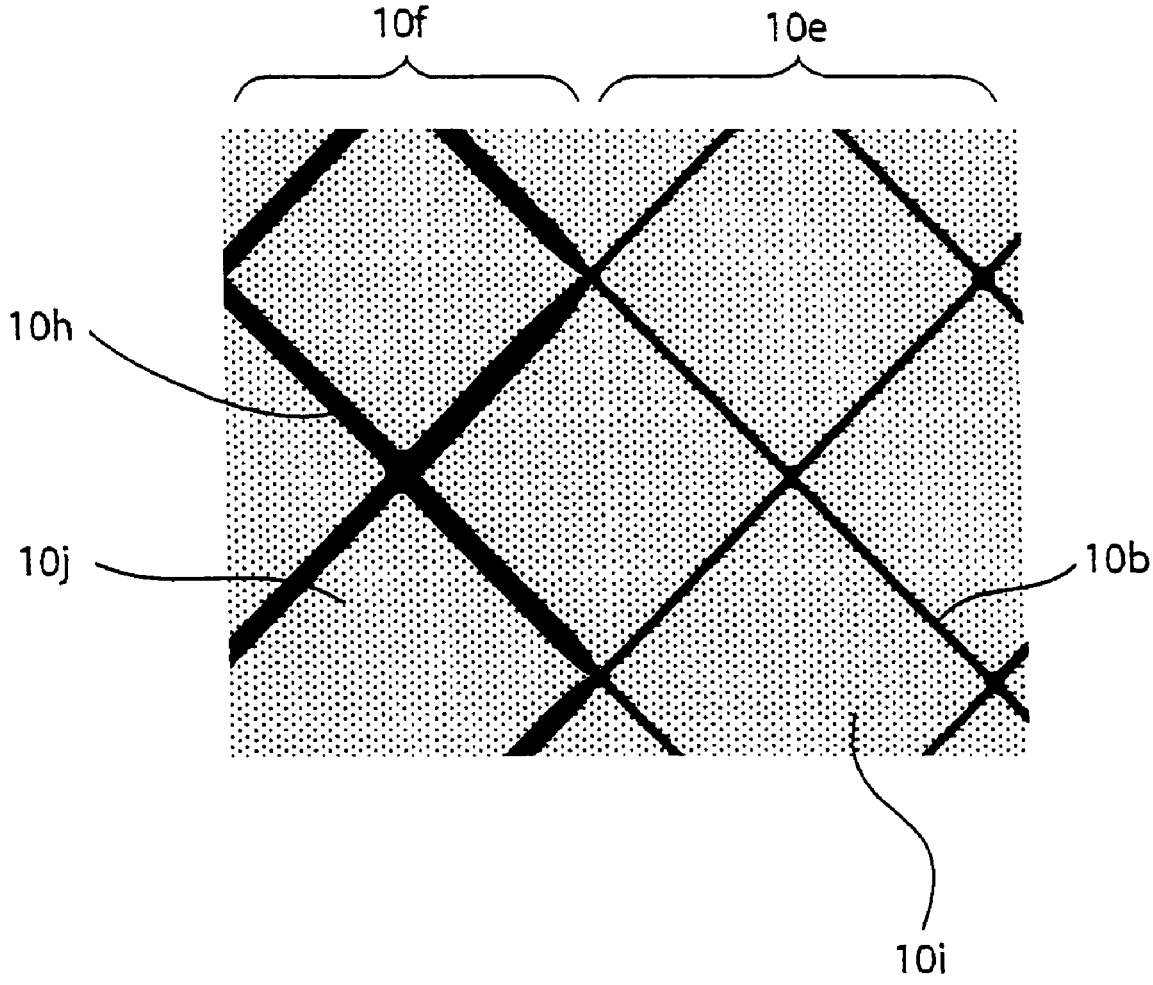
FIG. 9 is an enlarged view wherein a part of letter part of FIG. 8 is enlarged.

As shown as a enlarged view in FIG. 9, the letter section 10*f* is constructed from a electrically conductive section (thick band) 10*h* of a electrically conductive wire with a wider width than that of the electrically conductive wire of the mesh section 10*e* and the aperture surface area of an aperture section 10*j* in the letter section 10*f* is adjusted to be smaller than the aperture surface area of the aperture section 10*i*, so that the light transmittance is changed and accordingly, the boundary of the mesh section 10*e* and the letter section 10*f* is emphasized to make the latter part outstanding.

Figure 10:
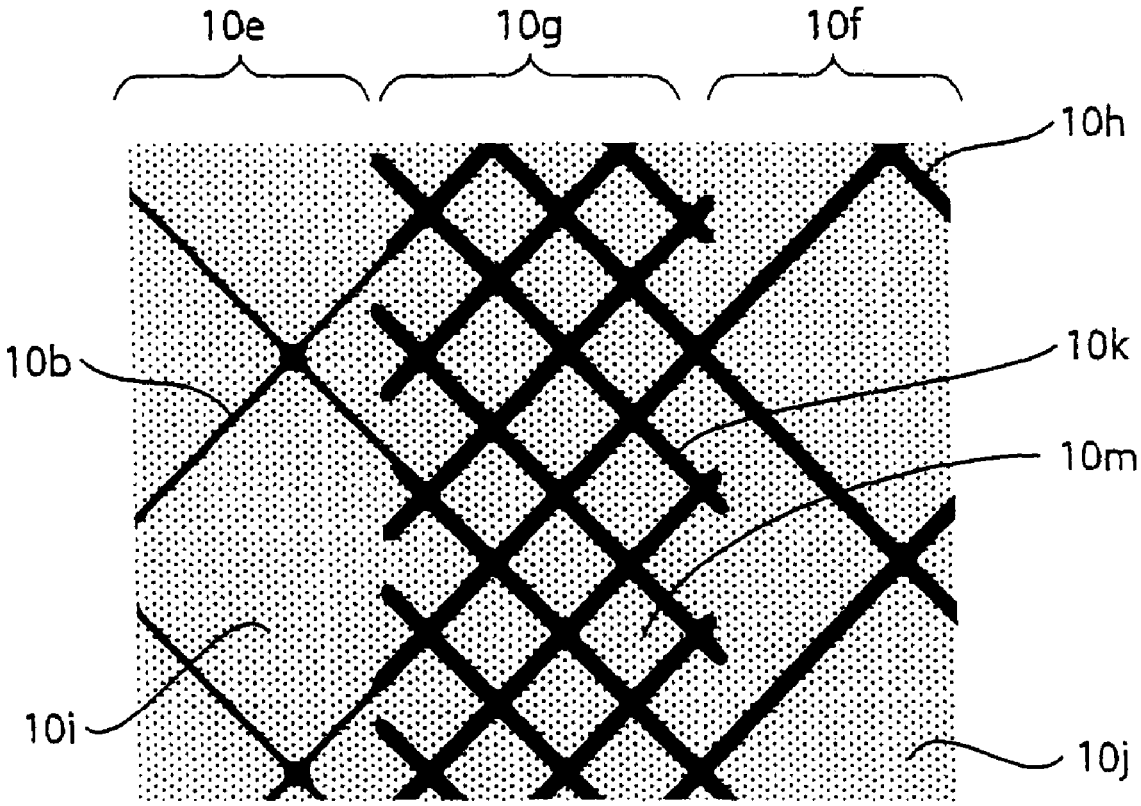
FIG. 10 is an enlarged view of a letter shadow part of FIG. 8.

On the other hand, the letter shadow section 10*g* shown in FIG. 8 has the same width as that of the electrically conductive wire of the letter section 10*f* as seen in further enlarged view of FIG. 10, however it is configured using the electrically conductive section 10*k* in a mesh pattern further denser than the letter section 10*f* and thus the aperture surface area of an aperture section 10*m* in the letter shadow section 10*g* is adjusted to be smaller than the aperture surface area of the aperture section 10*j* in the letter section 10*f*, so that the letter shadow section 10*g* can be emphasized. The aperture surface area of an aperture section 10*m* in the letter shadow section 10*g* is set to be about ¾ to ¼ of the aperture surface area of the letter section 10*f*.

The letter section 10*f* and the letter shadow section 10*g* have a function as a distinguishing pattern for recognizing a part of the antenna pattern by decreasing a prescribed quantity of the light passing through the meshes.

Accordingly, as shown in FIG. 8, the letter section 10*f* is formed in dark mesh pattern on the pale color mesh section 10*e* and the letter shadow section 10*g* in a dense mesh pattern is formed in the right side of the letter section 10*f*.

As a result, the designed logo 10*d* can be clearly outstandingly seen.

Moreover, the logo 10*d* formed in the above-mentioned manner keeps the mesh pattern having the aperture sections with difference in the thickness and density and therefore, no light transmitting property is lost.

Figure 11:
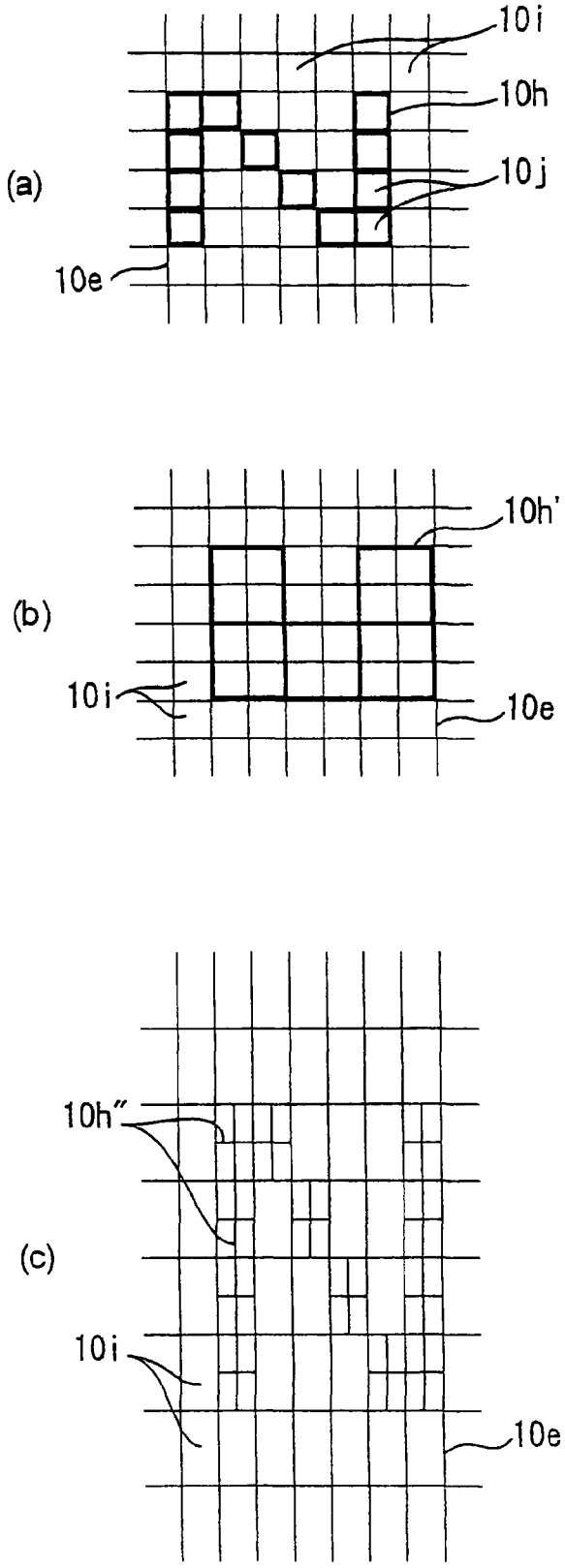
FIGS. 11 (*a*) to (*c*) are explanatory drawings showing a method of letter design by emphasizing.
Figure 12:
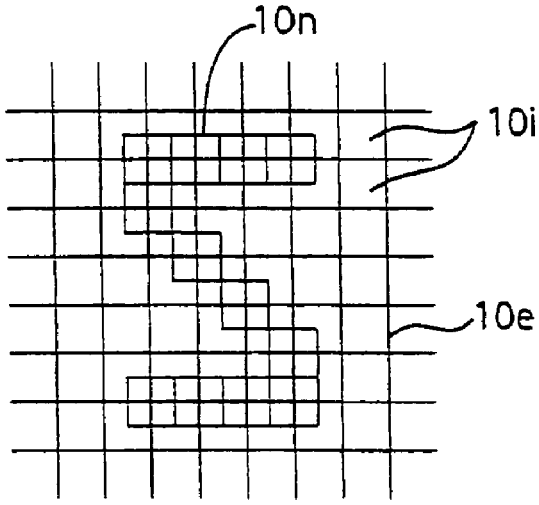
FIG. 12 is an explanatory drawing showing a method of letter design by shifting of the diagram.
Figure 13:
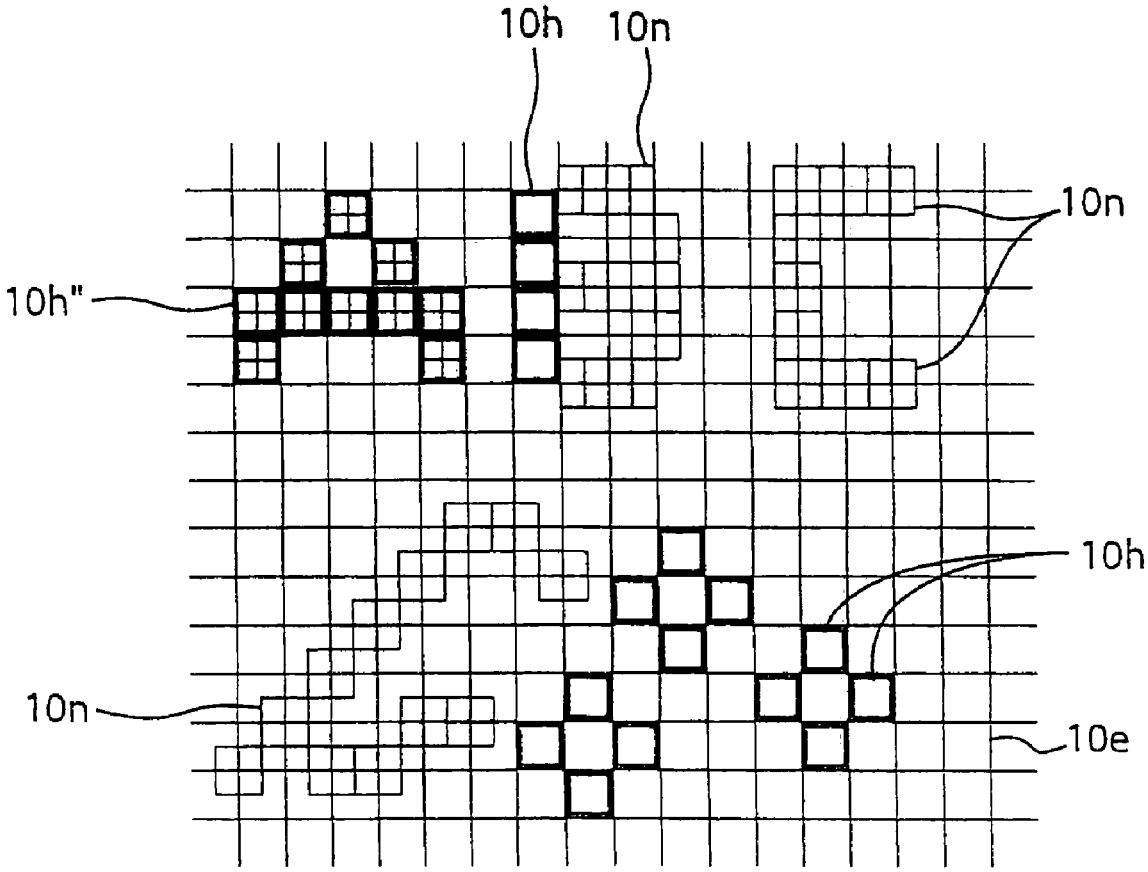
FIG. 13 is an explanatory drawing showing a method of letter design using emphasizing and diagram shifting.

FIGS. 11 to 13 show various kinds of formation methods of the distinguishing patterns.

FIG. 11(*a*) shows each mesh of the mesh section 10*e* as a unit and an electrically conductive section 10*h* constructed from an electrically conductive wire with a width thicker than that of the electrically conductive wire of the mesh section 10*e* to emphasize the logo "N".

FIG. 11(*b*) shows a plurality of meshes (four meshes in this drawing) as a unit and a electrically conductive section 10*h*' formed in the meshes using a electrically conductive wire with a width thicker than that of the electrically conductive wire of the mesh section 10*e* to emphasize the U-shape logo.

FIG. 11(*c*) shows a single mesh divided into a plurality of meshes (four divided sections in this drawing) as a unit and a electrically conductive section 10*h*" in a cross form formed in the mesh to emphasize the logo "N".

FIG. 12 shows the logo "S" in a state that the letter pattern 10*n* is shifted to a part of the mesh section 10*e* having an aperture section 10*i* with a square shape: and the square shape composing the latter pattern 10*n* is made to have the same size as the square shape composing the mesh section 10*e* and shifted in parallel along the diagonal direction of the aperture section 10*i* in the mesh section 10*e*.

FIG. 13 shows a combination of the emphasizing method illustrated for FIG. 11 and the emphasizing method by shifting illustrated for FIG. 12. If various kinds of emphasizing methods are employed as described, not only letters, but also designed patterns can be arbitrarily expressed.

In the above-mentioned embodiment, the letter patterns are formed continuously on the antenna pattern, however if the letter patterns can be recognized as letters, the letter patterns may be formed intermittently by, for example skipping one mesh.

Next, a production process of a transparent antenna of the present invention on which letters or patterns are designed will be described.

Example 3

A 125 μm-thick transparent polyester film and a 18 μm-thick copper foil were laminated through an adhesive and a transparent pressure sensitive adhesive layer was formed on a face opposite the copper foil of the polyester film.

Next, after liquid-like photoresist was applied to the copper foil face, exposure was carried out using a photomask.

The photomask had an antenna pattern mainly having aperture parts in a square lattice (20 μm in line width of the electrically conductive section, 500 μm in wiring pitches of the electrically conductive section) and a different square lattice (40 μm in line width of the electrically conductive section, 500 μm in wiring pitches of the electrically conductive section) with a different aperture ratio was formed in a part of the antenna pattern along a letter shape.

The antenna pattern having the above-mentioned square lattices with different aperture ratios was produced on the basis of CAD data inputted by a personal computer, using an automatic drawing apparatus.

Next, the resist on parts other than the antenna pattern was removed using developer solution by a conventionally known development treatment and further etching was carried out and resist removal was carried out using a stripping solution to form a letter shape design on the antenna pattern.

In the light transmitting antenna produced in the above-mentioned manner, it was confirmed that the square lattices (see reference symbol 10*h*) with different aperture ratios as shown in FIG. 11(*a*) appeared and that the latter formed on the antenna pattern was integrated with the antenna pattern and was excellent in a design. Further, with respect to the square lattice (reference symbol 10*h*) parts with different aperture ratios, since the translucency was reliably maintained, the transparency was good.

Example 4

After a transparent anchor layer in which an electroless plating catalyst was dispersed was formed on a 100 μm-thick transparent polycarbonate film, electroless plating and electroplating was carried out to obtain a 5 μm-thick electrically conductive layer and form low-reflection layers on both faces.

Thereafter, photoresist was applied and exposure was carried out using a photomask.

The photomask had an antenna pattern mainly having aperture parts in a square lattice (30 μm in line width of the electrically conductive section, 800 μm in wiring pitches of the electrically conductive section) and a square lattice (30 μm in line width of the electrically conductive section, 800 μm in wiring pitches of the electrically conductive section) was moved in parallel to a part of the antenna pattern to form a pattern along a letter shape.

Next, a conventionally known development treatment, etching, and resist removal were carried out to design the letter shape in the antenna pattern.

In the translucent antenna produced in the above-mentioned manner, it was confirmed that letters appeared in the state that the square lattices (see reference symbol 10*n*) with different aperture ratios, as shown in FIG. 12, and as a result, the translucent antenna with good transparency and excellent design was obtained.

Example 5

After a transparent anchor layer in which an electroless plating catalyst was dispersed was formed on a 125 μm-thick transparent polyester film, electroless plating and electroplating was carried out to obtain a 4 μm-thick electrically conductive layer.

Thereafter, photoresist was applied and exposure was carried out using a photomask.

The photomask had a pattern mainly having aperture parts in a rectangular lattice (20 μm in line width of the electrically conductive section, wiring pitches of electrically conductive section: 500 μm in transverse direction×900 μm in vertical direction) and a pattern along a letter shape was formed in a part of the antenna pattern with a square lattice (20 μm in line width of the electrically conductive section, wiring pitches of electrically conductive section: 250 μm in transverse direction×450 μm in vertical direction) having a changed aperture ratio by dividing a single rectangular lattice into 4 parts.

Next, a conventionally known development treatment, etching, and resist removal were carried out to design the letter shape in the antenna pattern. As a result, a translucent antenna with good transparency and excellent design was obtained.

Example 6

A design with a letter shape was formed on an antenna pattern in the same manner as Example 3 by carrying out conventionally known etching treatment and resist removal, except that printing resist was used and patterning was carried out using an antenna pattern mainly having aperture parts in a square lattice (30 μm in line width of the electrically conductive section, 500 μm in wiring pitches of the electrically conductive section) and a screen plate having a letter shape in a square lattice (100 μm in line width of the electrically conductive section, 500 μm in wiring pitches of the electrically conductive section) with different aperture ratios on a part of the antenna pattern. As a result, although the pattern formation precision was decreased as compared with that by the photoresist method shown in above-mentioned Examples 3 to 5, a translucent antenna with good transparency and excellent design was easily obtained.

According to the above-mentioned second embodiment, while maintaining the light transmittance and antenna performance, the transparent antenna excellent in design can be provided.

a-3. Third Embodiment of Transparent Antenna for Display

A transparent antenna shown as the third embodiment is made to harmonize a transparent antenna and front glass while maintaining the light transmittance and antenna performance.

Figure 14:
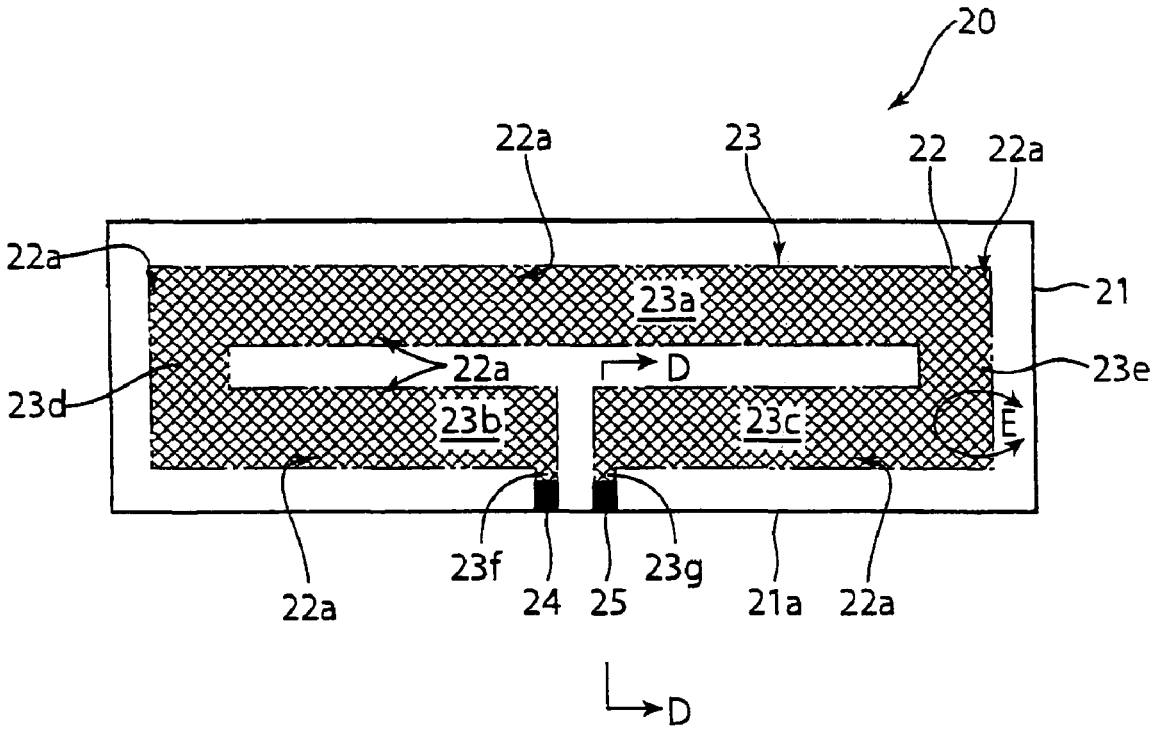
FIG. 14 is an enlarged view showing a third embodiment of the transparent antenna for a display.

In a transparent antenna 20 shown in FIG. 14, an antenna pattern 23 was formed planarly as an electrically conductive section 22 on a transparent plastic sheet 21.

The antenna pattern 23 is constructed from a band-like pattern 23*a* formed longitudinally in almost the entire length of the transparent plastic sheet 21, band-like patterns 23*b* and 23*c* arranged at a distance and in parallel to the band-like pattern 23*a*, connection parts 23*d* and 23*e* for connecting the band-like patterns 23*a* and 23*b* as well as the band-like patterns 23*a* and 23*c*, respectively, and lead parts 23*f* and 23*g* extending toward a lower rim 21*a* of the transparent plastic sheet 21 from the opposed band-like patterns 23*b* and 23*c*, and antenna terminals 24 and 25 are attached to the tip ends of the respective lead parts 23*f* and 23*g*.

The meshes in the electrically conductive section 22 are composed by regularly continuing geometric designs with the same size and the same shape and the transmittance of light passing through the electrically conductive section 22 can be controlled by changing the setting of the aperture surface area of the meshes.

The above-mentioned antenna terminals 24 and 25 are for sticking an electric power supply part of an antenna cord, which is not shown and the antenna terminals 24 and 25 are constructed from a square sheet electrically connected with the electrically conductive section 22.

Figure 15:
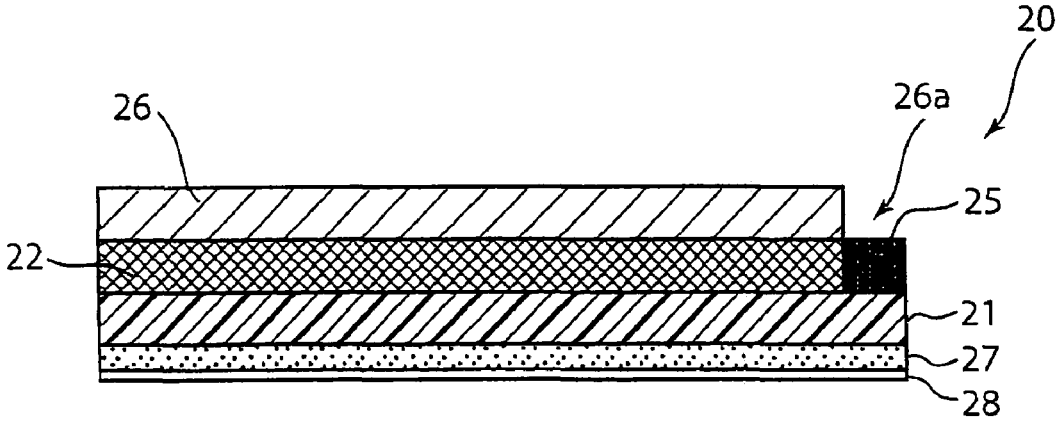
FIG. 15 is a cross sectional view of FIG. 14 as viewed from the direction of arrow D-D.

FIG. 15 is a cross-sectional view along the line D-D in FIG. 14.

In the drawing, the electrically conductive section 22 of a mesh structure is formed on the transparent plastic sheet 21 and the electrically conductive section 22 is covered with a transparent protection film 26.

A through hole part 26*a* is formed in a part of the transparent protection film 26 and the antenna terminal 25 is exposed to the through hole part 26*a*. The electric power supply part of the antenna cord is stuck to the exposed antenna terminal 25.

Reference numeral 27 denotes a transparent pressure sensitive adhesive layer and reference numeral 28 denotes a separating sheet.

Figure 16:
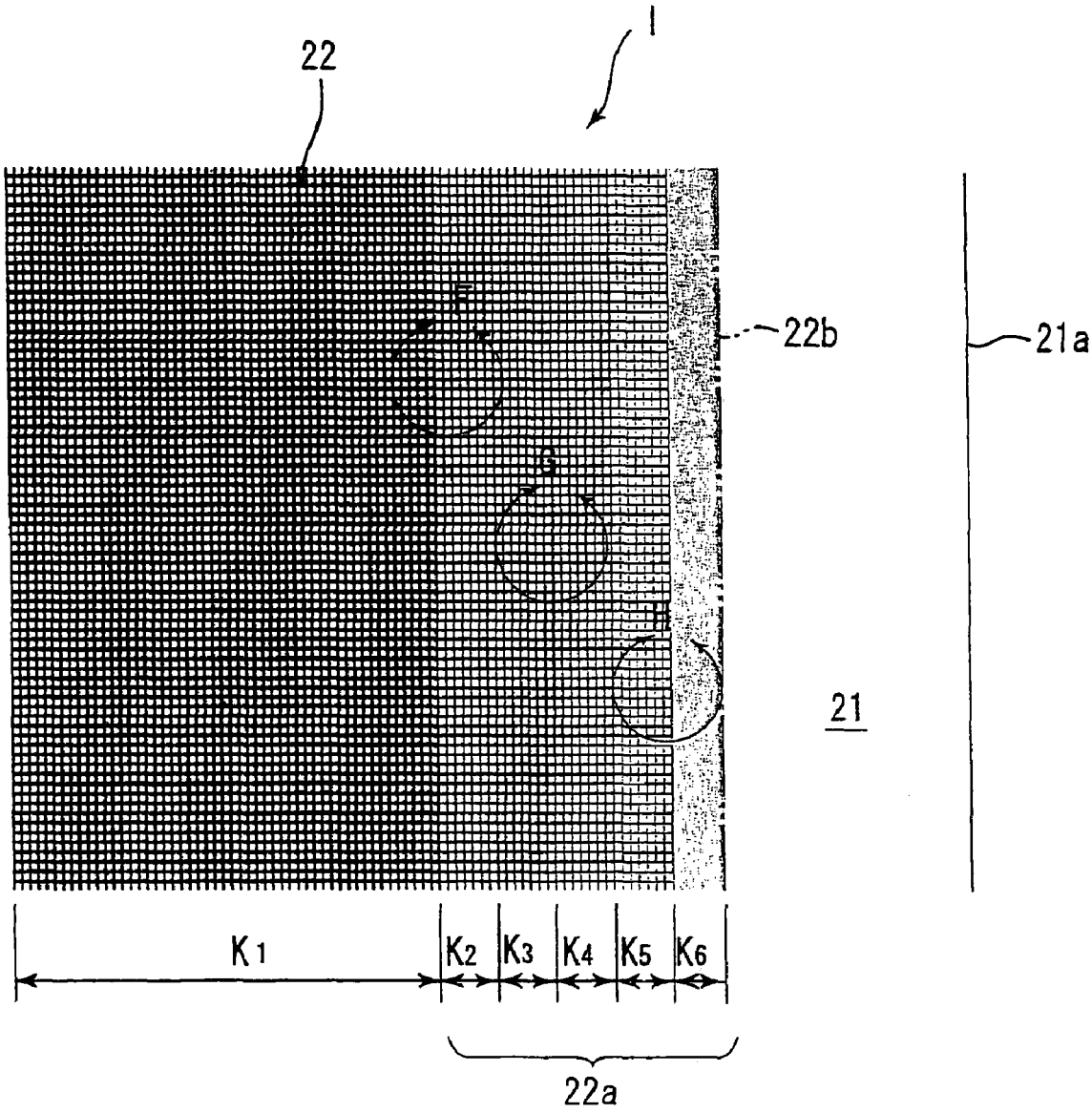
FIG. 16 is an enlarged view of section E in FIG. 14.

FIG. 16 is an enlarged view of an E part in FIG. 14, that is the boundary region of the antenna pattern 23 and the transparent plastic sheet 21, which is an antenna pattern non-formation section.

With respect to FIG. 16, in a boundary region I, a gradation section 22*a* for decreasing the luminance difference between the antenna pattern 23 and an antenna pattern non-formation section is formed.

In the drawing, reference symbol $K_1$ denotes an electrically conductive section region forming the antenna pattern. Reference symbol $K_2$ denotes a first region with slightly brighter tone (higher light transmittance) than the electrically conductive section region $K_1$ in the gradation section 22*a* formed in the outer rim section of the electrically conductive section region $K_1$; reference symbol $K_3$ denotes a second region with further brighter tone than the first electrically conductive section region $K_2$; reference symbol $K_4$ denotes a third region with further brighter tone than the second electrically conductive section region $K_3$; reference symbol $K_5$ denotes a fourth region with further brighter tone than the third electrically conductive section region $K_4$; and reference symbol $K_6$ denotes a fifth region with further brighter tone than the fourth electrically conductive section region $K_5$.

The light transmittance of the fifth electrically conductive section region $K_6$ is approximately close to the light transmittance of the transparent plastic sheet 21.

In the drawing, reference numeral 22*b* denotes the outermost periphery edge of the gradation section 22*a* and reference numeral 21*a* shows the right rim of the transparent plastic sheet 21.

The light transmittance, which is a gauge of the transparency, means the total luminous transmittance for the quantity of the total luminance of light with entire wavelength emitted from a light source having a specified color temperature and transmitted through a sample face. If the light transmittance is lower than 70%, when the transparent antenna 20 is attached, for example, to the display, the difference between the light transmittance of the display and the light transmittance of the transparent antenna 20 becomes wide to make the antenna pattern of the transparent antenna 20 appear dark. Therefore, the existence of the antenna becomes an obstacle.

The above-mentioned light transmittance is measured using a spectroscopic analyzer (model number NDH 2000) manufactured by Nippon Denshoku Industries Co., Ltd. Also, the light transmittance 100% in an air layer is defined as the standard.

In the case where the transparent protection film 26 is formed in the transparent antenna 20, the measurement of the light transmittance is carried out in the state that the transparent protection film 26 is included and in the case where the transparent pressure sensitive adhesive layer 27 is formed, the measurement is carried out in the state that the transparent pressure sensitive adhesive layer 27 is included.

Figure 17:
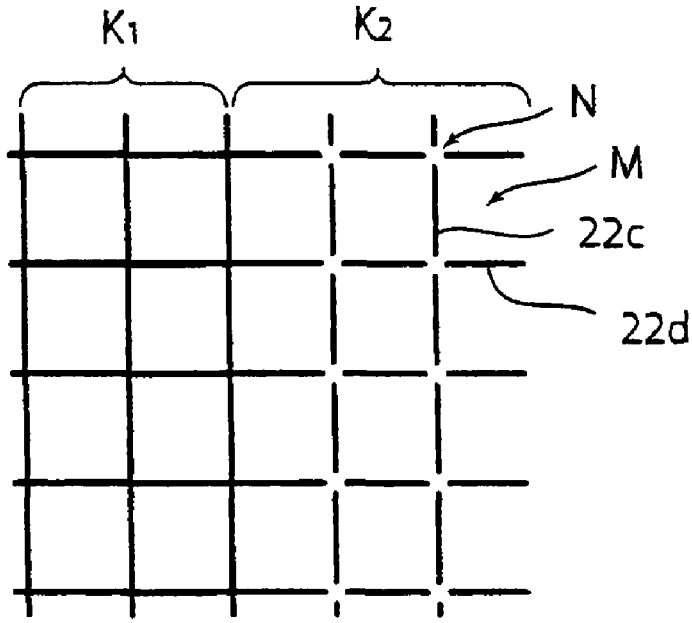
FIG. 17 is an enlarged view of section F in FIG. 16.
Figure 18:
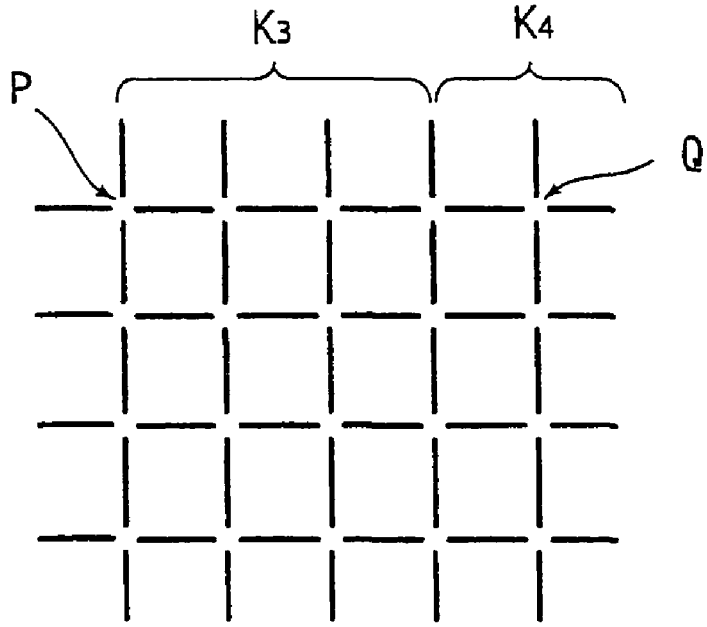
FIG. 18 is an enlarged view of section G in FIG. 16.
Figure 19:
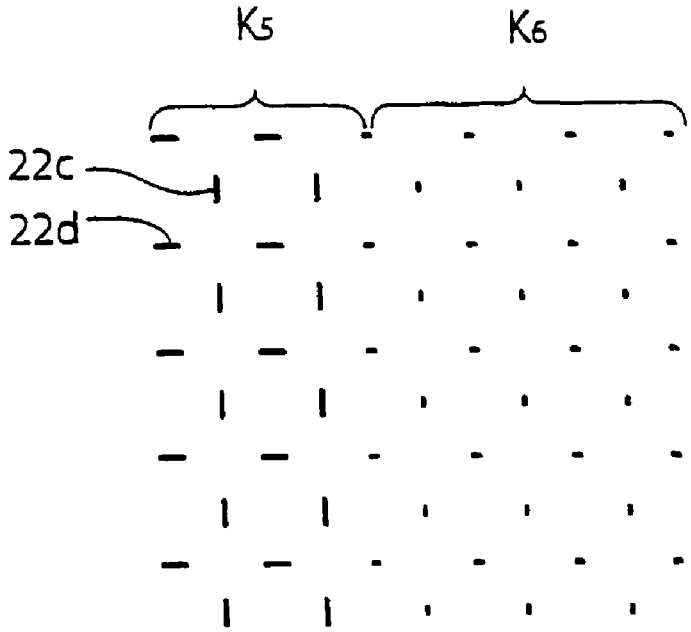
FIG. 19 is an enlarged view of section H in FIG. 16.

FIG. 17 is an enlarged view of an F part in FIG. 16; FIG. 18 is an enlarged view of a G part in FIG. 16; and FIG. 19 is an enlarged view of an H part in FIG. 16.

At first, in FIG. 17, the first region $K_2$ formed in the outside of the electrically conductive section region $K_1$ loses all of the crossing points of the vertical direction electrically conductive wire 22*c* forming the lines of the mesh and the transverse direction electrically conductive wire 22*d* and in such a manner, formation of the crossing point-lost section N increases the light transmittance than that in the conducive part region $K_1$.

The wire width w of the vertical direction electrically conductive wire 22*c* and the transverse direction electrically conductive wire 22*d* is made to be 30 μm width or thinner. If the wire width w exceeds 30 μm, the meshes of the antenna pattern become outstanding and the design is also worsened. If the wire width w is 30 μm or thinner, the existence of the antenna pattern is hardly recognized. Additionally, if the film thickness of the electrically conductive wire is controlled to give the aspect ratio of the wire width/film thickness t of 0.5 or higher, production of an antenna pattern with good precision is easily made.

In this embodiment, the light transmittance of the transparent antenna 20 is adjusted to keep 70% or higher light transmittance by selecting combination of the wire width of the vertical direction electrically conductive wire 22*c* and the transverse direction electrically conductive wire 22*d* and aperture size of the meshes formed by surrounding with these electrically conductive wires 22*c* and 22*d*.

In FIG. 18, the second region $K_3$ formed in the outside of the first region $K_2$ has a wider lost range of the crossing point of the vertical direction electrically conductive wire 22*c* and the transverse direction electrically conductive wire 22*d* than the above-mentioned crossing point-lost section N and formation of such a crossing point-lost section P increases the light transmittance than that in the electrically conductive section region $K_1$.

On the other hand, the third region $K_4$ formed in the outside of the second region $K_3$ has a wider crossing point-lost section Q than the crossing point-lost section P.

In the fourth region $K_5$ shown in FIG. 19, a part of the vertical direction electrically conductive wire 22*c* and a part of the transverse direction electrically conductive wire 22*d* exist while keeping the directionality and the mesh shape is lost.

In the fifth region $K_6$, a part of the vertical direction electrically conductive wire 22*c* and a part of the transverse direction electrically conductive wire 22*d* exist in island-like dotted state while scarcely keeping the directionality.

In such a manner, due to the gradation section 22*a* having the luminous tone gradually increased step by step (5 grades in this embodiment) from the electrically conductive section 22, the boundary part of the antenna pattern 23 and the transparent plastic sheet 21 is hardly noticeable and the existence of the antenna pattern 23 itself can also be made unnoticeable.

FIG. 20 to FIG. 23 show modification examples of the gradation section 22*a*.

Figure 20:
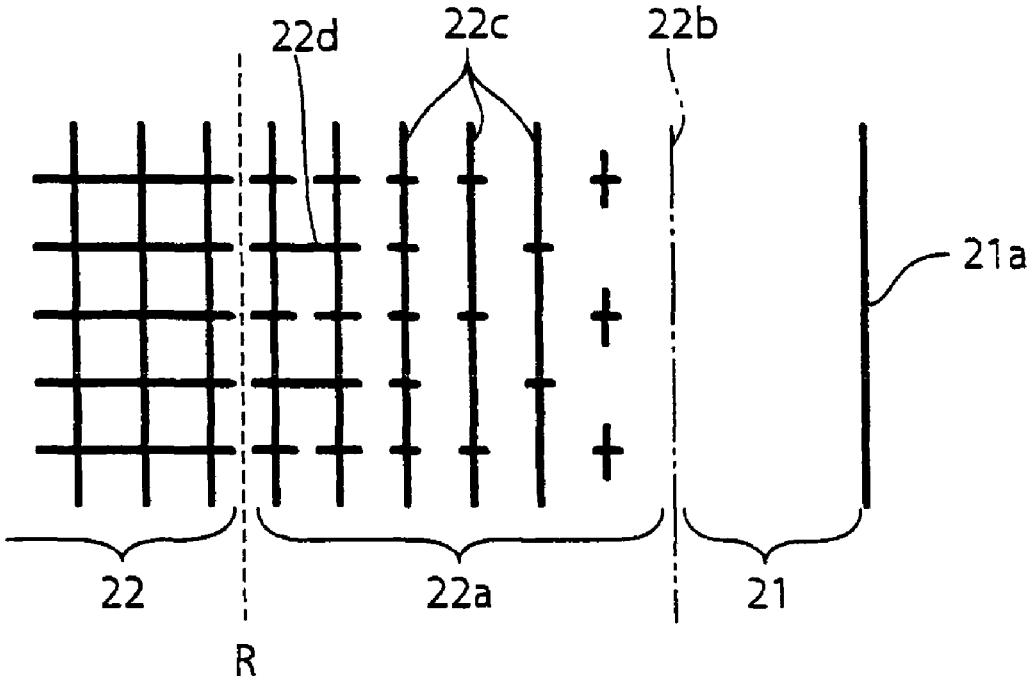
FIG. 20 is an explanatory drawing showing a first variation of the gradation in a third embodiment.

At first, with respect to the gradation section 22*a* shown in FIG. 20, the gradation provided with light transmittance is formed by leaving the vertical direction electrically conductive wire 22*c* and eliminating a plurality of points in the right side end portion of the transverse direction electrically conductive wire 3*d*. In the drawing, reference symbol R denotes a boundary of the electrically conductive section 22 and the gradation section 22*a*: reference symbol 22*b* denotes the outermost periphery rim of the gradation section 22*a*: and 21 denotes a transparent plastic sheet, respectively.

Figure 21:
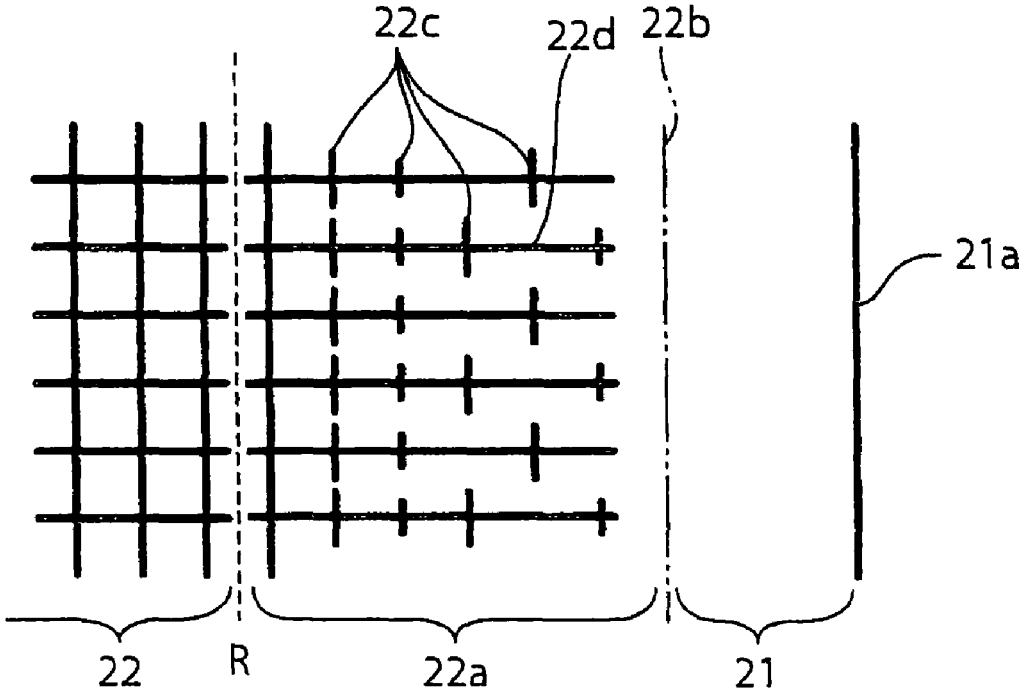
FIG. 21 is an explanatory drawing showing a second variation of the gradation.

With respect to the gradation section 22*a* shown in FIG. 21, contrary to FIG. 20, the gradation provided with light transmittance is formed by leaving the transverse direction electrically conductive wire 22*d* and eliminating a plurality of points of the vertical direction electrically conductive wire 22*c*.

Figure 22:
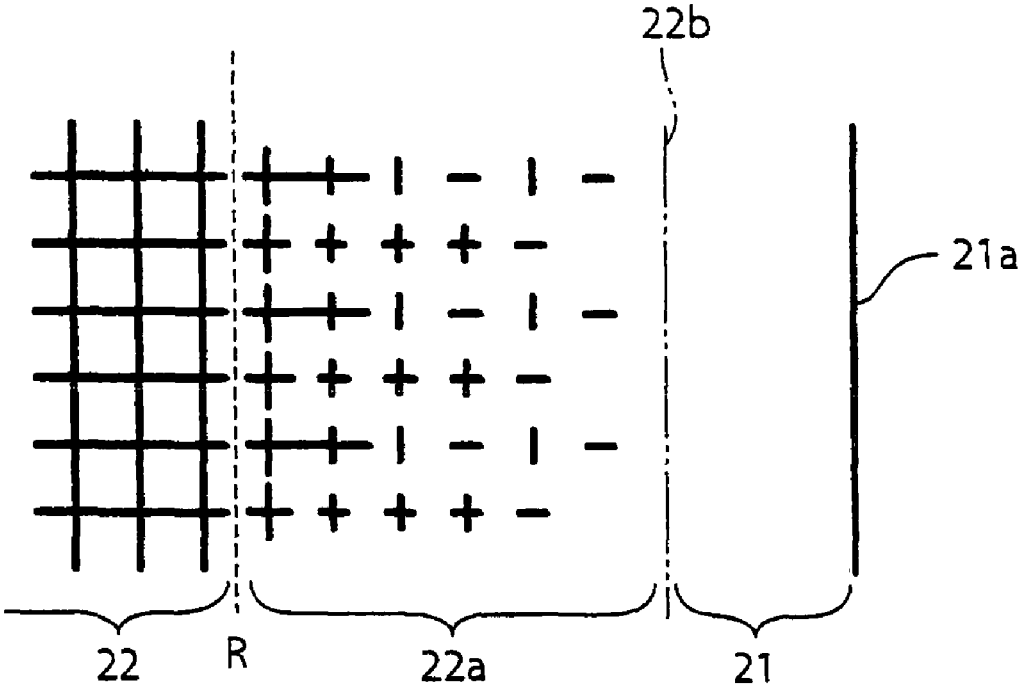
FIG. 22 is an explanatory drawing showing a third variation of the gradation.

With respect to the gradation section 22*a* shown in FIG. 22, the techniques of FIG. 20 and FIG. 21 are combined and gradation provided with light transmittance is formed by eliminating a plurality of points in part of the transverse direction electrically conductive wire 22*d* and the vertical direction electrically conductive wire 22*c* respectively.

Although the light transmittance of FIG. 20 and FIG. 21 is approximately same, the light transmittance of FIG. 22 becomes high as compared with that of FIG. 20 and FIG. 21.

Figure 23:
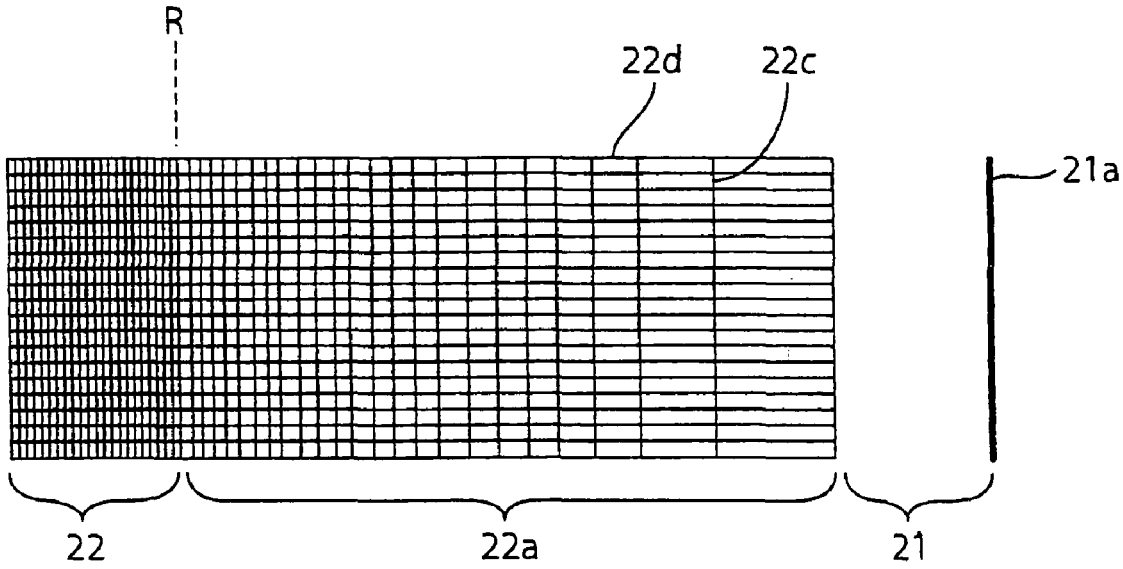
FIG. 23 is an explanatory drawing showing a forth variation of the gradation.

In the embodiments shown in FIG. 20 to FIG. 22, gradation is formed by eliminating the electrically conductive wires, and on the other hand, as shown in FIG. 23, the gradation section 22*a* may be formed by coarsening the meshes, in particular, widening the intervals of vertical direction electrically conductive wire 22*c* forming the meshes step by step toward the transparent plastic sheet.

According to the gradation section 22*a*, although the gradation effect is low as compared with that by the above-mentioned elimination of the electrically conductive wires, the gradation section 22*a* has an advantageous that the part is also made usable as an antenna.

Next, the production process of a transparent antenna 20 having the gradation section 22*a* of the present invention will be described.

Example 7

A 100 μm-thick transparent polyester film and a 18 μm-thick copper foil were laminated using an adhesive and a transparent pressure sensitive adhesive layer was formed on a face opposite the copper foil of the polyester film.

Next, after liquid-phase photoresist was applied to the copper foil face, exposure was carried out using a photomask.

The photomask had an antenna pattern mainly having aperture parts in a square lattice (20 μm in line width of the electrically conductive wire, 500 μm in wiring pitches of the electrically conductive wire) and a gradation section shown in FIG. 20 was formed in the rim portion of the antenna pattern.

The antenna pattern having the square lattice and the gradation section was produced on the basis of CAD data inputted on a personal computer, using an automatic drawing apparatus.

Next, the resist on parts other than the antenna pattern was removed by a conventionally known development treatment using a developer solution and further etching was carried out and resist removal was carried out using a stripping solution to form the antenna pattern having the gradation part.

The light transmitting antenna produced in the above-mentioned manner showed extremely natural gradation in the rim portion of the antenna pattern and it was confirmed that the boundary of the antenna pattern and the transparent plastic sheet was not recognized and the existence of the antenna pattern itself was hardly recognized.

Example 8

After a transparent anchor layer in which an electroless plating catalyst was dispersed was formed on a 100 μm-thick transparent polycarbonate film, electroless plating and electroplating was carried out to obtain a 5 μm-thick electrically conductive layer and form low-reflection layers on both faces.

Thereafter, photoresist was applied and exposure was carried out using a photomask.

The photomask had an antenna pattern mainly having aperture parts in a square lattice and the gradation section as shown in FIG. 21 was formed in the rim portion of the antenna pattern.

Next, etching and resist removal were carried out to form an antenna pattern having the gradation section (20 μm in wire width of the electrically conductive wire, and 80 μm in wiring pitches of the electrically conductive wire).

The light transmitting antenna produced in the above-mentioned manner showed extremely natural gradation in the rim portion of the antenna pattern and it was confirmed that the boundary of the antenna pattern and the transparent plastic sheet was not recognized and the existence of the antenna pattern itself was hardly recognized.

Example 9

After a transparent anchor layer in which an electroless plating catalyst was dispersed was formed on a 125 μm-thick transparent polyester film, electroless plating and electroplating was carried out to obtain a 4 μm-thick electrically conductive layer. Thereafter, photoresist was applied and exposure was carried out using a photomask.

The photomask had an antenna pattern mainly having aperture parts in a rectangular lattice (10 μm in wire width of the electrically conductive wire, and wiring pitches: 600 μm in transverse direction×900 μm in vertical direction) and the gradation section as shown in FIG. 23 was formed in the rim portion of the antenna pattern.

Next, etching and resist removal were carried out to form an antenna pattern having the gradation section.

The light transmitting antenna produced in the above-mentioned manner showed extremely natural gradation in the rim portion of the antenna pattern and it was confirmed that the boundary of the antenna pattern and the transparent plastic sheet was not recognized and the existence of the antenna pattern itself was hardly recognized.

Example 10

An antenna pattern having a gradation section was formed in the same manner as Example 7 by carrying out conventionally known etching treatment and resist removal, except that printing resist was used and patterning was carried out using a screen plate in which an antenna pattern mainly having aperture parts in a square lattice (25 μm in line width of the electrically conductive wire, 1,000 μm in wiring pitches of the electrically conductive wire) was formed.

As a result, although the pattern formation precision was decreased as compared with that by photoresist method shown in above-mentioned Examples 7 to 9, a light transmitting antenna with gradation effect in the rim portion was easily obtained.

According to the above-mentioned second embodiment, while maintaining the light transmittance and antenna performance, the transparent antenna excellent in the design can be provided.

a-4. Fourth Embodiment of the Transparent Antenna for Display

The transparent antenna 30 shown in the fourth embedment has needed antenna length for a compact size.

Figure 24:
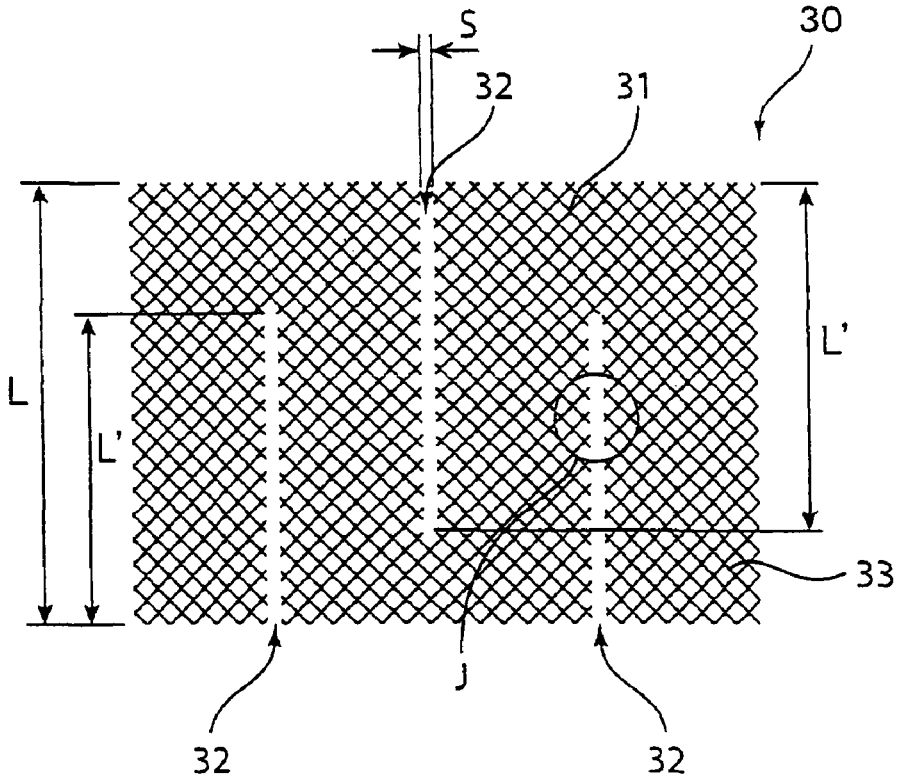
FIG. 24 is a plan view showing a forth embodiment of the transparent antenna for a display.

In FIG. 24, while using the antenna pattern 31 formed by continuously arranging the square meshes as an example, it will be explained. A plurality of slits 32 are formed in parallel in a part of antenna pattern 31. The respective slits 23 have length L' shorter than the vertical direction length L of the antenna pattern 30 and formed in alternately different directions. Accordingly, the antenna pattern 31 is formed zigzag in FIG. 24. In the drawing, reference numeral 33 denotes an electrically conductive section.

Figure 25:
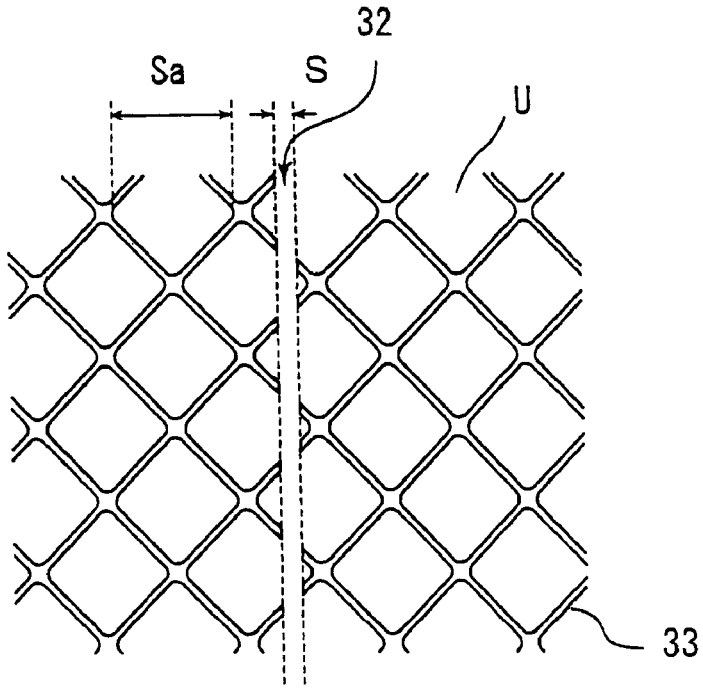
FIG. 25 is an enlarged view of section J in FIG. 24.

FIG. 25 is an enlarged view of a J part in FIG. 24, S shows the slit width and Sa shows the mesh size. In this case, the mesh size means the diagonal line length in the mesh U.

It is preferable to set the above-mentioned slit width S in a range from 20 μm to the maximum size of the mesh and if the slit width S is less than 20 μm, production becomes difficult and if the slit width S exceeds the maximum size of the mesh, the slits are seen outstandingly and the design is worsened.

If the antenna pattern 31 snaked by forming the above-mentioned slits 32 is expanded to be straight, it is possible to obtain the length with about ¼ of the wavelength of electric wave, for example UHF wave, to be received.

However, it is required for the arrangement of the slits to keep the slits from the crossing points of meshes U.

It is because if the slits 32 pass the crossing points 34 of the electrically conductive section 33 of the antenna pattern 31, the crossing points are continuously missed to make the existence of the slits outstandingly seen.

Figure 26:
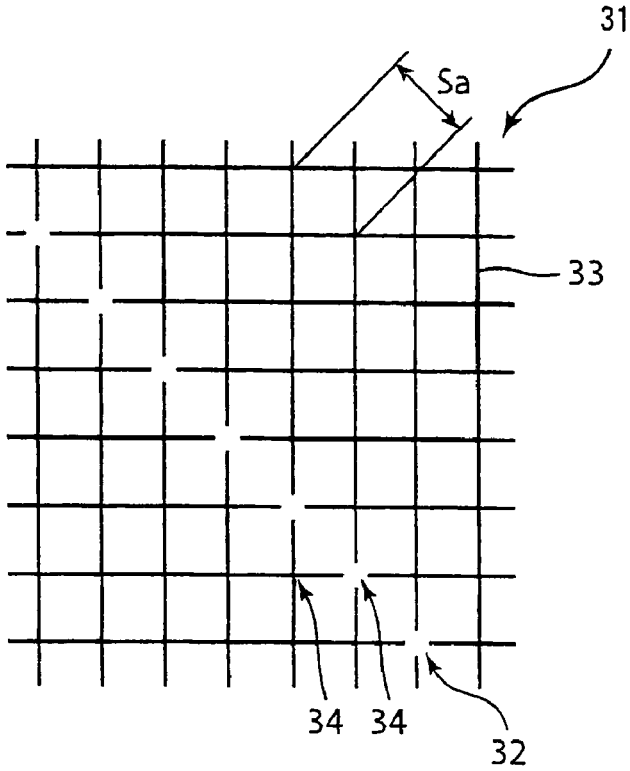
FIG. 26 is an explanatory drawing illustrating an arrangement of the slit.
Figure 27:
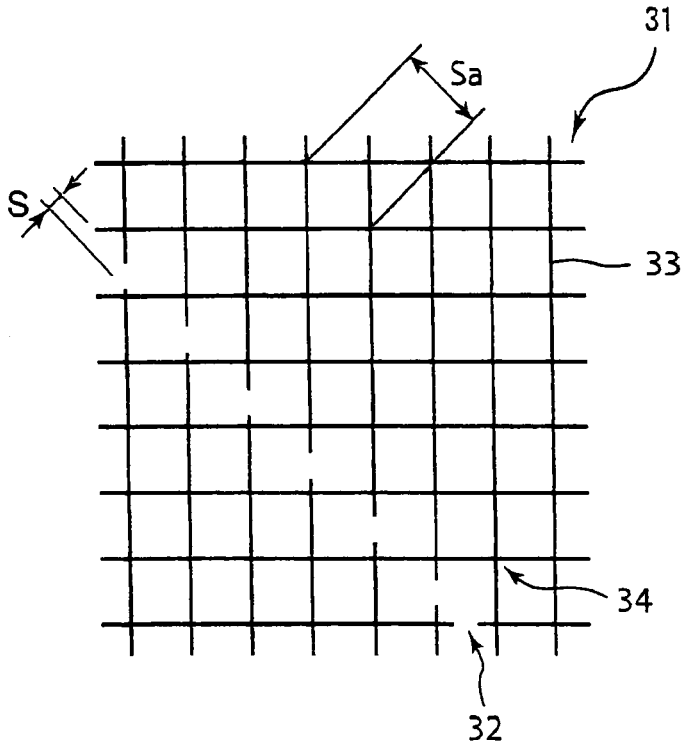
FIG. 27 is an explanatory drawing illustrating an arrangement of the slit.

On the other hand, FIG. 27 shows slits 32 avoiding the crossing points 34 of the electrically conductive section 34. As it is made clear by comparison with that in FIG. 26, the existence of the slits 32 is not outstandingly visible.

Figure 28:
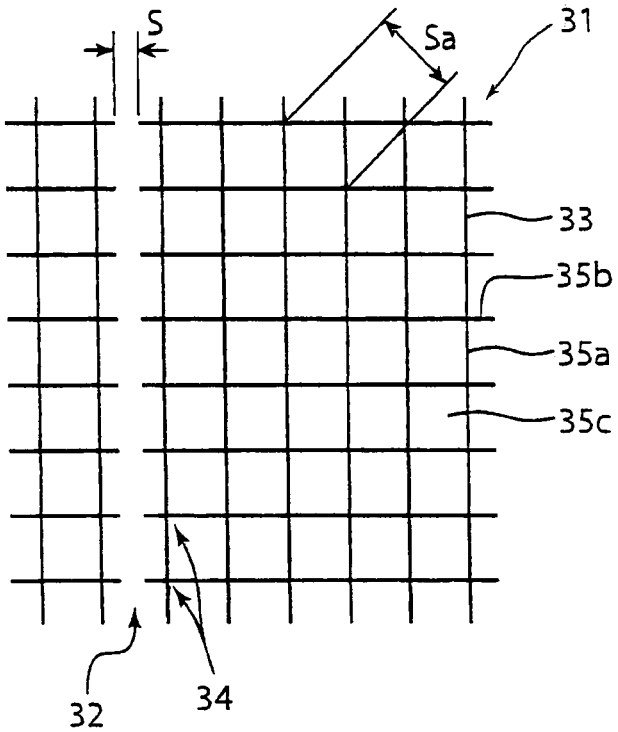
FIG. 28 is an explanatory drawing showing a mesh shape of the antenna pattern and an arrangement of the slit.

FIG. 28 shows an antenna pattern 31 of square meshes 35*c* formed by arranging the vertical direction electrically conductive wire 35*a* and transverse direction electrically conductive wire 35*b* at equal intervals and slits 32 are formed along the arrangement direction of the meshes (vertical direction in this drawing) in a part of the antenna pattern 31. The slit width S is set to be about ¼ of the size Sa of the meshes 35*c* and the slits do not pass the crossing point, the existence of the slits is scarcely seen.

Next, the production process of a transparent antenna 30 of the present invention will be described.

Example 11

After a transparent anchor layer in which a plating catalyst was dispersed was formed on a 100 μm-thick transparent polycarbonate film, plating was carried out to form a 8 μm-thick electrically conductive metal layer.

Figure 29:
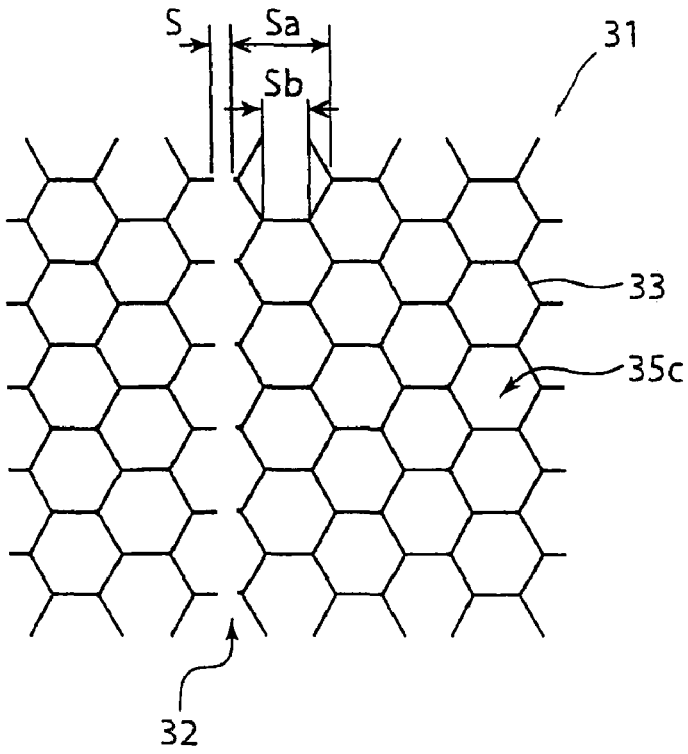
FIG. 29 is an explanatory drawing showing a mesh shape of the antenna pattern and an arrangement of the slit.

The electrically conductive metal layer was photo-etched to produce a transparent antenna as shown in FIG. 29.

In the transparent antenna, to make an aperture of the mesh 35*c* have a regular hexagonal shape, the wire width of the electrically conductive section 31 was set to be 12 μm and one side length Sb of the mesh 35*c* was set to be 600 μm and slits 32 with a width S of 100 μm were formed vertically on the antenna pattern 31.

With respect to the transparent antenna formed as described above, both of the antenna pattern 31 and the slits 32 formed on the antenna pattern 31 could not be seen. Accordingly, a transparent antenna was obtained without worsening the design.

Example 12

After a transparent anchor layer in which a plating catalyst was dispersed was formed on a 1 mm-thick transparent acrylic plate, plating was carried out to form a 12 μm-thick electrically conductive metal layer and an antenna pattern having slits was formed by photolithography.

Figure 30:
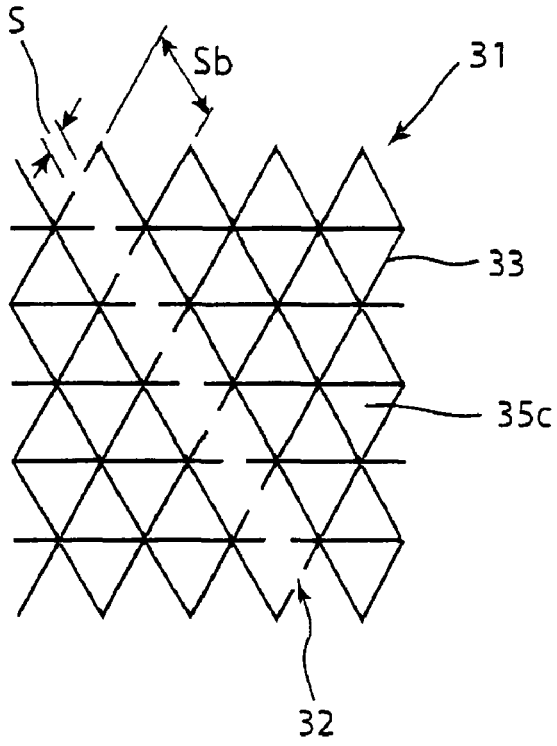
FIG. 30 is an explanatory drawing showing a mesh shape of the antenna pattern and an arrangement of the slit.

Next, chemical etching was carried out to produce a transparent antenna as shown in FIG. 30.

In the transparent antenna, to make an aperture of the mesh 35*c* have a regular triangle shape, the wire width of the electrically conductive section 33 was set to be 20 μm and one side length Sb of the mesh 35*c* was set to be 900 μm and slits 32 with a width S of 80 μm were formed slantingly along the mesh arrangement direction.

Further, a transparent resin coating with a thickness of 100 μm was formed as a transparent protection layer on the metal face side of the film in which the antenna pattern 31 was formed.

With respect to this transparent antenna, both of the antenna pattern 31 and the slits 32 formed on the antenna pattern 31 could not be seen. Accordingly, a transparent antenna was obtained without worsening the design.

Example 13

Figure 31:
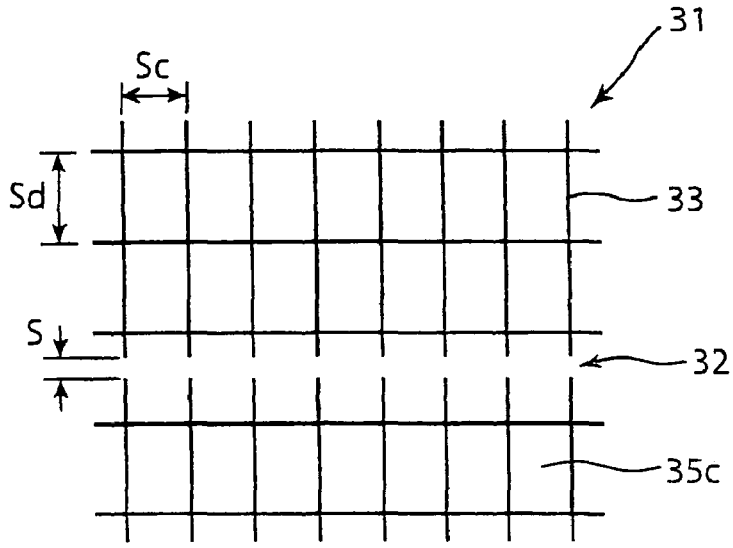
FIG. 31 is an explanatory drawing showing a mesh shape of the antenna pattern and an arrangement of the slit.

A 18 μm-thick copper foil both faces of which were chemically treated for low-reflection treatment was stuck to a 100 μm-thick transparent polyethylene terephthalate film and an antenna pattern having slits was formed by photolithography and then chemical etching was carried out to produce a transparent antenna as shown in FIG. 31.

In the transparent antenna, to make an aperture of the mesh 35*c* have a rectangular shape, the wire width of the electrically conductive section 33 was set to be 15 μm and the shorter side length Sc of a single mesh 35*c* was set to be 300 μm and the longer side length Sd was set to be 400 μm, respectively and slits 32 with a width S of 40 μm were formed transversely on the antenna pattern 31.

Next, a 100 μm-thick transparent polyethylene terephthalate film coated with a pressure sensitive adhesive as a transparent protection layer was stuck to the metal face side of the film on which the antenna pattern 31 was formed.

With respect to this transparent antenna, both of the antenna pattern 31 and the slits 32 formed on the antenna pattern 31 could not be seen and a transparent antenna was obtained without worsening the design.

Example 14

An antenna pattern having slits was formed by high precision printing using a silver nano-particle paste on a 800 μm-thick transparent polycarbonate plate to produce a transparent antenna having a 10 μm-thick electrically conductive layer as shown in FIG. 27.

In the transparent antenna, to make an aperture of the mesh 35*c* have a square shape, the wire width of the electrically conductive section 33 was set to be 30 μm and one side length Sa of a single mesh 35*c* was set to be 1 mm and slits 32 with a width S of 150 μm were formed slantingly at an angle of 45° to the mesh 35*c* on the antenna pattern 31.

With respect to this transparent antenna, both of the antenna pattern 31 and the slits 32 formed on the antenna pattern 31 could not be seen and a transparent antenna was obtained without worsening the design.

Example 15

After a transparent anchor layer in which a plating catalyst was dispersed was formed on a 50 μm-thick transparent polyethylene terephthalate film, copper plating was carried out to form a 5 μm-thick electrically conductive metal layer.

A resist film was formed on the electrically conductive metal layer and an antenna pattern having slits was formed by photolithography.

The resulting film was chemically etched using an iron chloride solution and the resist was peeled to produce a transparent antenna as shown in FIG. 29.

In the transparent antenna, the wire width of the electrically conductive section 33 having the mesh in a regular hexagonal shape was set to be 10 μm and one side length Sb of the mesh 35*c* was set to be 900 μm and slits 32 with a width S of 500 μm were formed vertically on such a antenna pattern 31.

With respect to the transparent antenna formed in the above-mentioned, both of the antenna pattern 31 and the slits 32 formed on the antenna pattern 31 could not be seen. Accordingly, a transparent antenna was obtained without worsening the design.

Example 16

A 12 μm-thick copper foil both faces of which were chemically treated for low-reflection treatment was stuck to a 2 mm-thick transparent glass plate to form a electrically conductive metal layer.

A resist film was formed on the electrically conductive metal layer and an antenna pattern having slits was formed by photolithography. Successively, chemical etching was carried out using a cupric chloride solution and the resist was peeled to produce a transparent antenna as shown in FIG. 30.

In the transparent antenna, the wire width of the electrically conductive section 33 having the mesh in a regular triangle shape was set to be 18 μm and one side length Sb of the mesh 35*c* was set to be 700 μm and slits 32 with a width S of 300 μm were formed slantingly along the arrangement direction of the mesh 35*c* on such a antenna pattern 31.

With respect to the transparent antenna formed in the above-mentioned, both of the antenna pattern 31 and the slits 32 formed on the antenna pattern 31 could not be seen. Accordingly, a transparent antenna was obtained without worsening the design.

Example 17

A 12 μm-thick copper foil whose both faces were chemically treated for low-reflection treatment was stuck to a 200 μm-thick transparent acrylic film to form a electrically conductive metal layer.

A resist film was formed on the electrically conductive metal layer and an antenna pattern having slits was formed by photolithography. Successively, chemical etching was carried out using a cupric chloride solution and the resist was peeled to produce a transparent antenna as shown in FIG. 28.

In the transparent antenna, the wire width of the electrically conductive section 33 having the mesh in a square shape was set to be 15 μm and one side length Sa of the mesh 35*c* was set to be 1 mm and slits 32 with a width S of 1 mm were formed vertically to the mesh 35*c* on such a antenna pattern 31.

With respect to the transparent antenna formed in the above-mentioned, both of the antenna pattern 31 and the slits 32 formed on the antenna pattern 31 could not be seen. Accordingly, a transparent antenna was obtained without worsening the design.

Next, with reference to FIG. 32 to FIG. 36, slit formation patterns in a transparent antenna will be described. The respective drawings show the state observed in a plane view.

Figure 32:
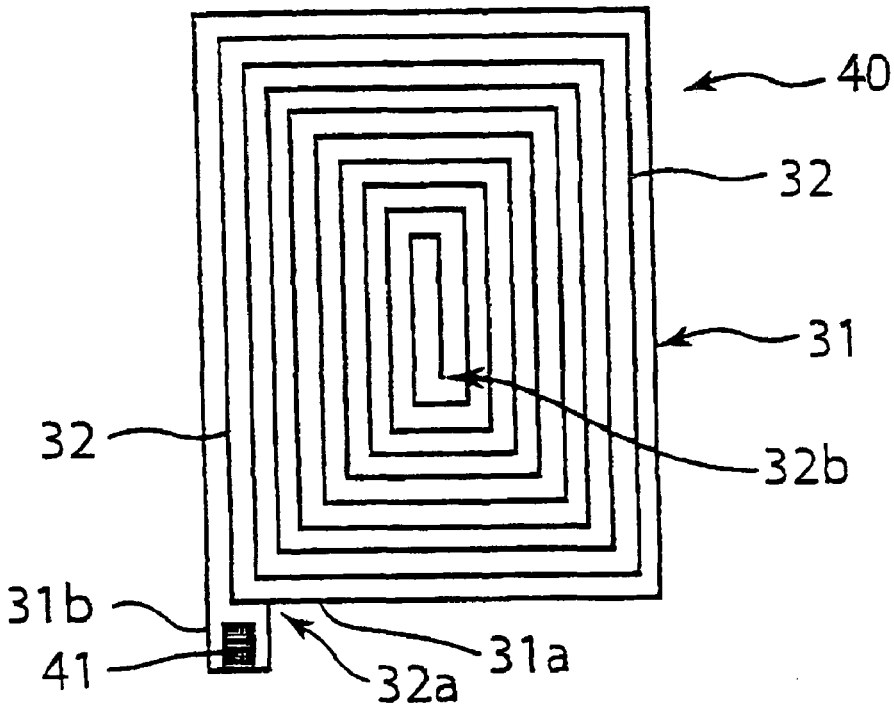
FIG. 32 is a plan view showing a first formation pattern of the slit.

A transparent antenna 40 shown in FIG. 32 has a rectangular antenna pattern 31 and a slit 32 is formed on the antenna pattern 31.

The slit 32 has starting point 32*a* of the slit at the boundary portion of the lower rim 31*a* of the antenna pattern 31 and a tub 31*b* projected from the lower rim 31*a* and is formed in spiral state toward the center along the outline of the antenna pattern 31 and the approximately the center of the antenna pattern 31 is the terminal point 32*b* of the slit 32. In this drawing, reference numeral 41 shows an antenna terminal formed in the tub 31*b*.

Figure 33:
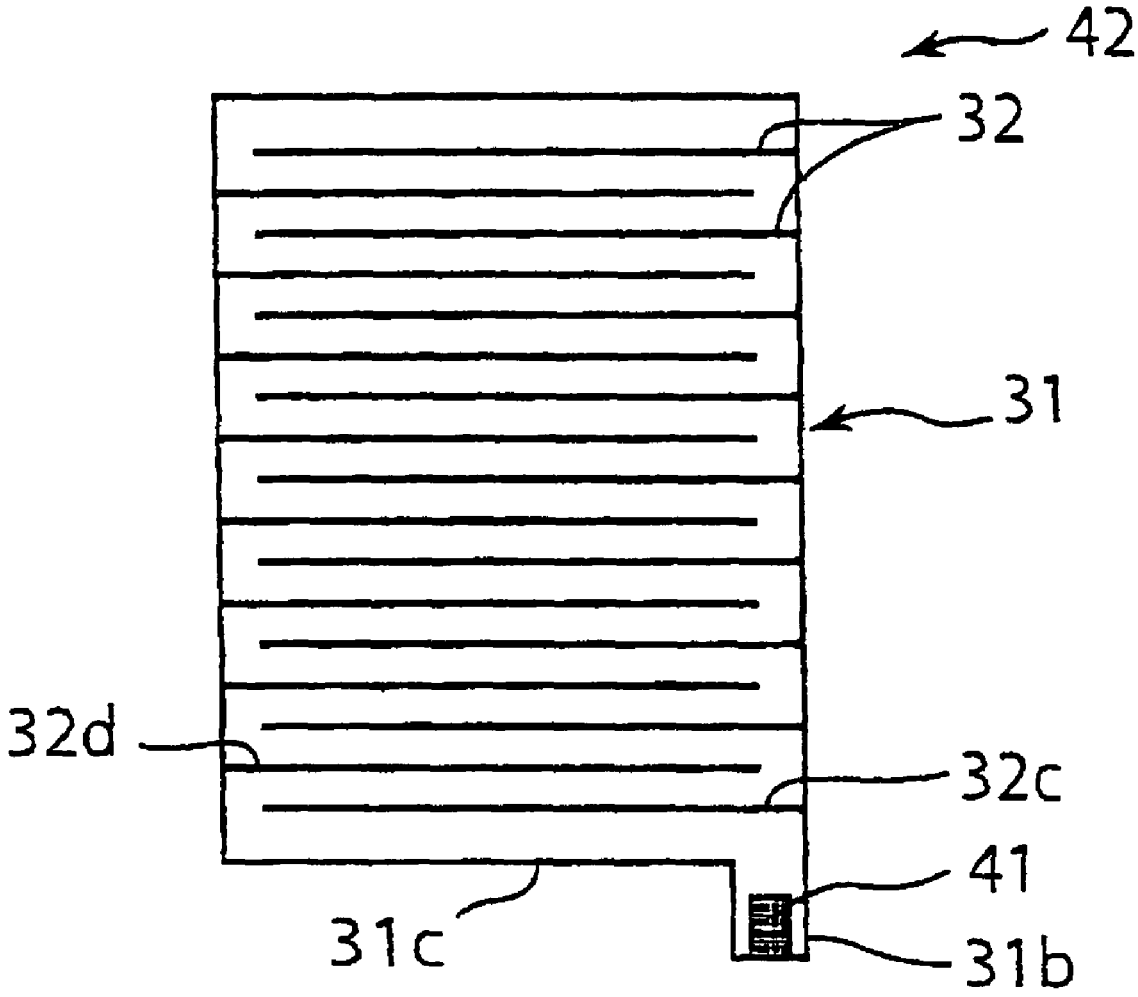
FIG. 33 is a plan view showing a second formation pattern of the slit.

A transparent antenna 42 shown in FIG. 33 has a rectangular antenna pattern 31 and slits 32 are formed on the antenna pattern 31. Hereinafter, same symbols are assigned for the same components as those in FIG. 32 and their explanations will be omitted in the following description.

A plurality of slits 32 are formed in parallel to the shorter side 31*c* of the antenna pattern 31 and among a plurality of the slits 32, slits 32*c* are formed with a slightly shorter length than the shorter side 31*c* from the right rim of the antenna pattern 31 and slits 32*d* are formed also with a slightly shorter length than the shorter side 31*c* from the left rim of the antenna pattern 31. The slits 32 are formed by alternately arranging the slits 32*c* and the slits 32*d* in the vertical direction and accordingly, the antenna pattern 31 snaking in the vertical direction is formed.

Figure 34:
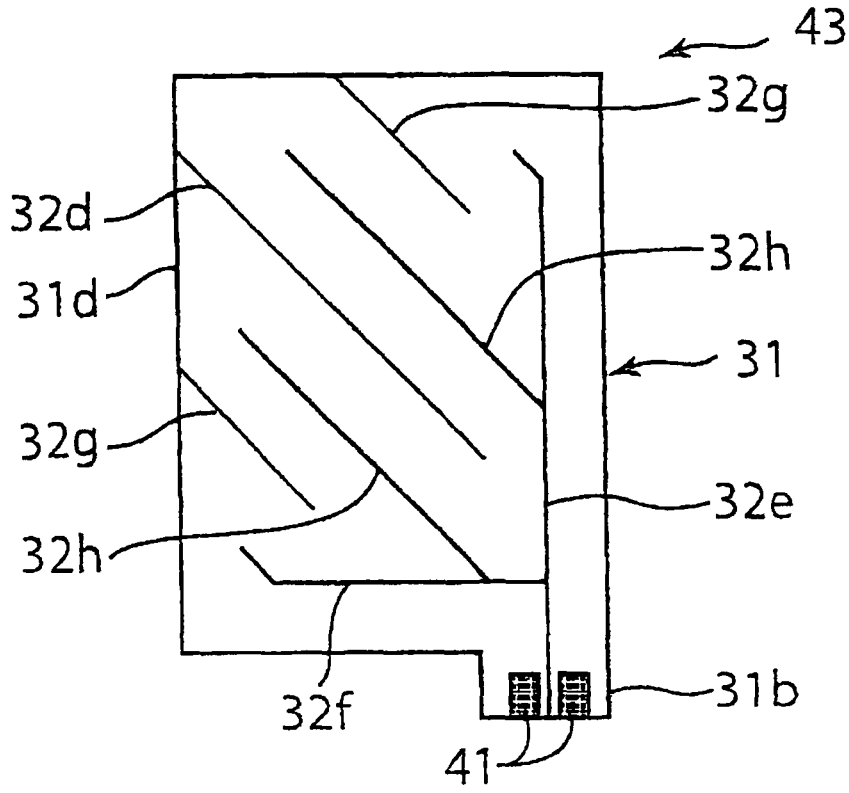
FIG. 34 is a plan view showing a third formation pattern of the slit.

A transparent antenna 43 shown in FIG. 34 has a rectangular antenna pattern 31 and provided with slits 32*e* extended in the vertical direction from the center of the tub 31*b* in the tub width direction, slits 32*f* branched in the transverse direction from the middle of the slits 32*e*, and a plurality of slits 32*g* and 32*h* formed slantingly in parallel state.

The slits 32*g* are formed by cutting from the lower rim of the antenna pattern 31 and formed in a prescribed length without crossing the slits 32*e* and 32*f*, on the other hand, the slits 32*h* are formed by cutting from the slits 32*e* or 32*f* and formed in a prescribed length without reaching the left rim 31*d* of the antenna pattern 31. Accordingly, the slantingly snaked antenna pattern 31 is formed within a range surrounded with the slits 32*e* and 32*f*.

Figure 35:
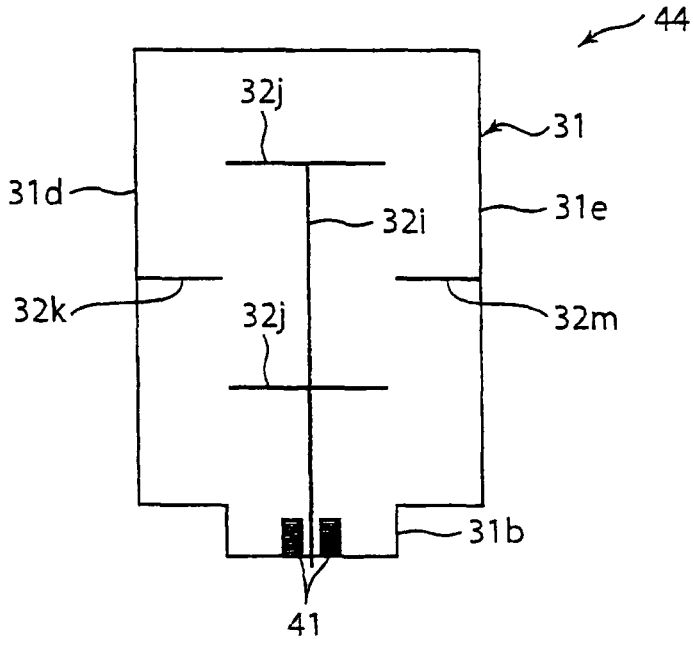
FIG. 35 is a plan view showing a forth formation pattern of the slit.

A transparent antenna 44 shown in FIG. 35 has a rectangular antenna pattern 31 and is provided with a slit 32*i* extended in a prescribed length from the center of the tub 31*b* in the tub width direction, a plurality slits 32*j* and 32*j* at right angles to the slit 32*i*, a slit 32*k* formed by cutting in a prescribed length from the left rim 31*d* of the antenna pattern 31, and a slit 32*m* formed by cutting in a prescribed length from the right rim 31*e*.

Accordingly, antenna pattern 31 snaked in a left half and a right half of the antenna pattern 31 are formed while having the slit 32*i* as the boundary.

Figure 36:
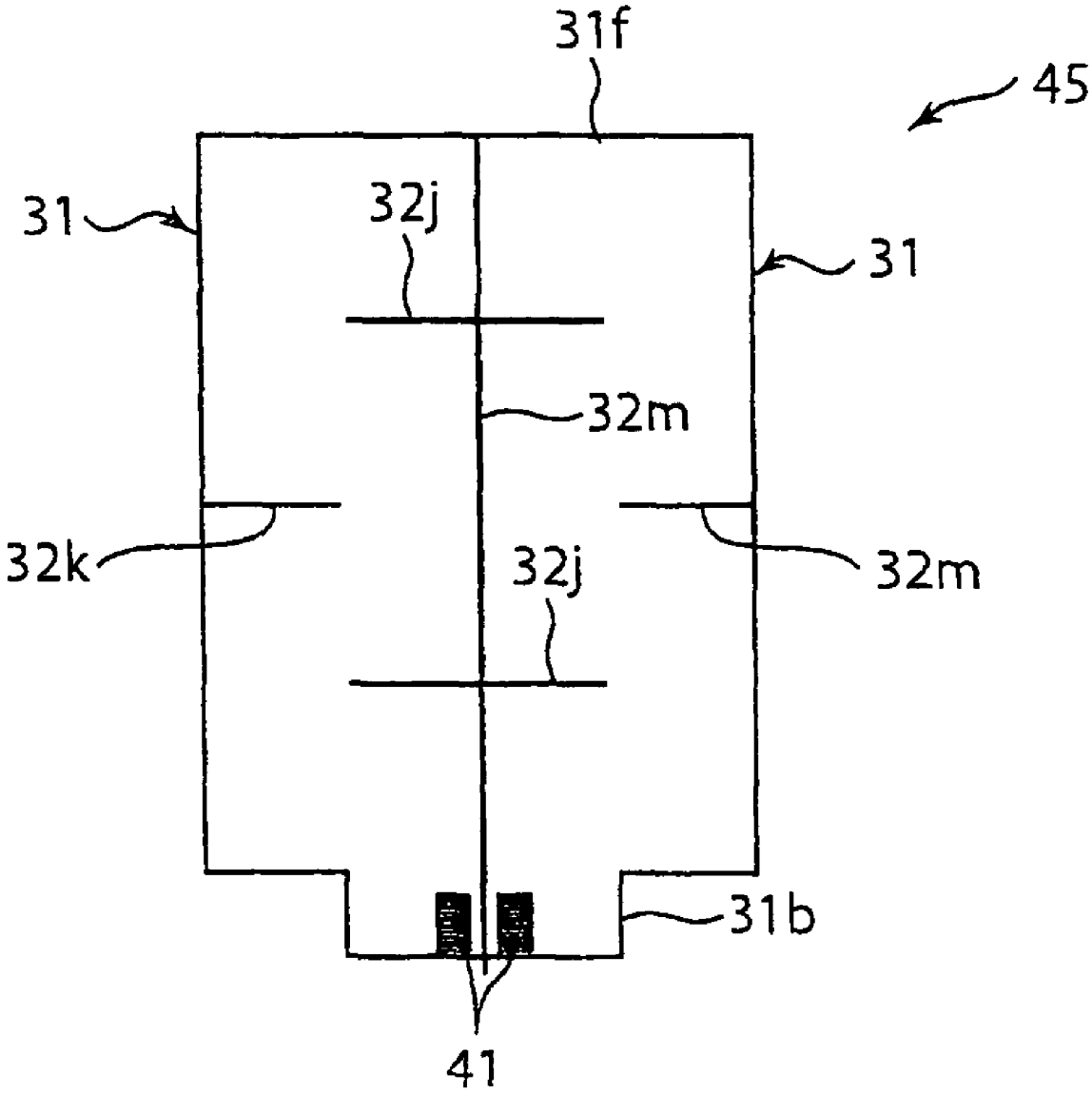
FIG. 36 is a plan view showing a fifth formation pattern of the slit.

A transparent antenna 45 shown in FIG. 36 has a rectangular antenna pattern 31 and the different point of the antenna pattern from that antenna pattern shown in FIG. 35 is that the slit 32*n* formed in place of the 32*i* is extended to the upper rim 31*f* of the antenna pattern 31.

As described, since the antenna pattern 31 is divided right and left by the slit 32 n, these two antenna patterns 31, 31 are arranged adjacently and compose the transparent antenna.

c. Housing Component with an Antenna c-1. In Case where the Housing Component has an Opaque Decorative Section A housing component with an antenna according to the present invention is composed in a manner that it can be attached to a device without damaging a design provided on a housing of the device.

Figure 37:
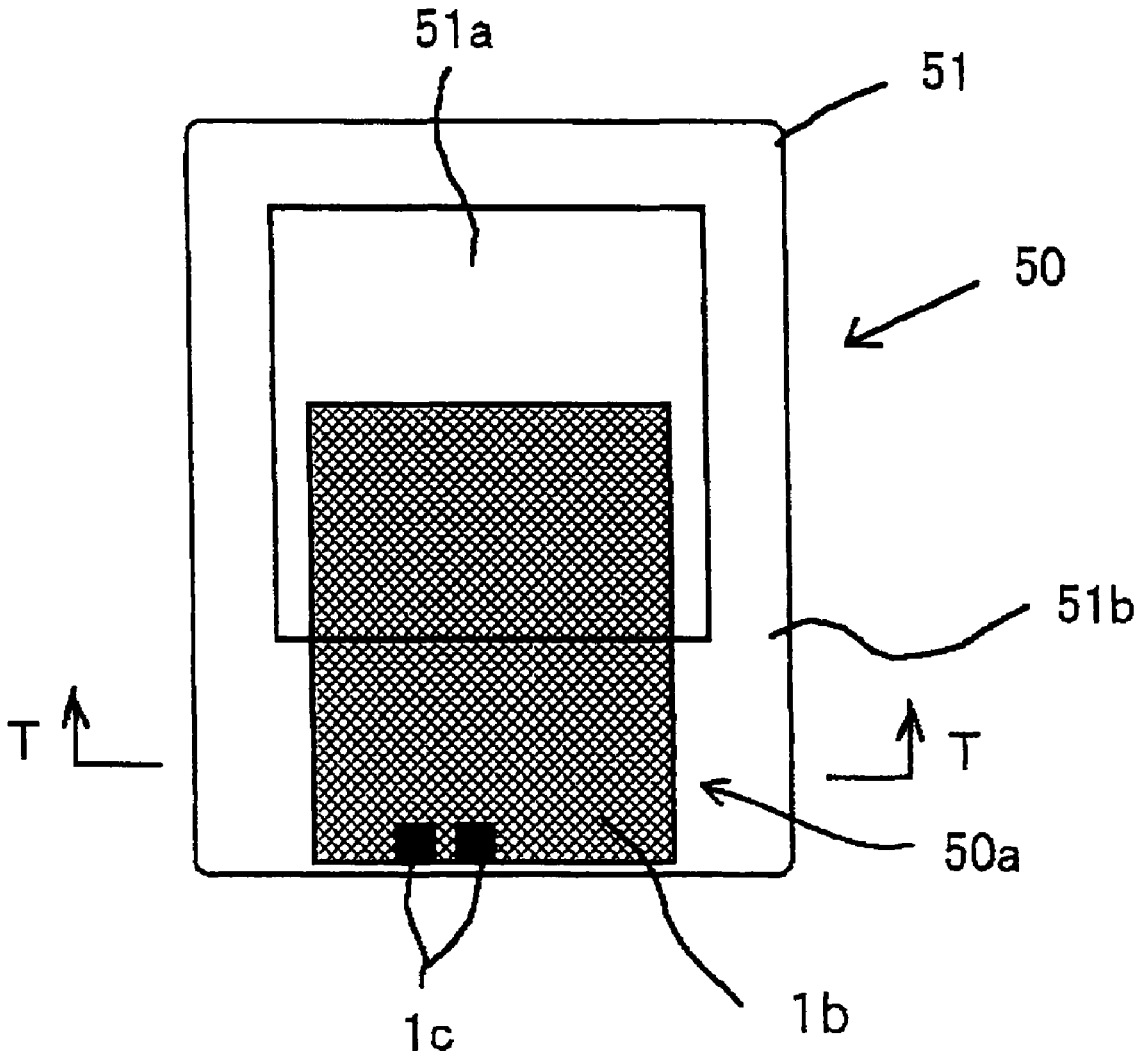
FIG. 37 is a front view of housing component with an antenna according to the present invention.

In FIG. 37, the housing component with an antenna (hereinafter, abbreviated as housing component) 50 is composed of a resin plate 51 including a transparent window section 51*a* and an opaque decorative section 51*b* surrounding the transparent window section 51*a* in a frame form, and an antenna pattern as an electrically conductive section 1*b* formed on a surface of the opaque decorative section 51*b*. Herein, a symbol 1*c* denotes electrode part of the antenna pattern.

The housing component is designed to constitute a part of a TV display (including a table-top type) and a part of a housing of a mobile terminal device such as a mobile phone and the like.

Figure 38:
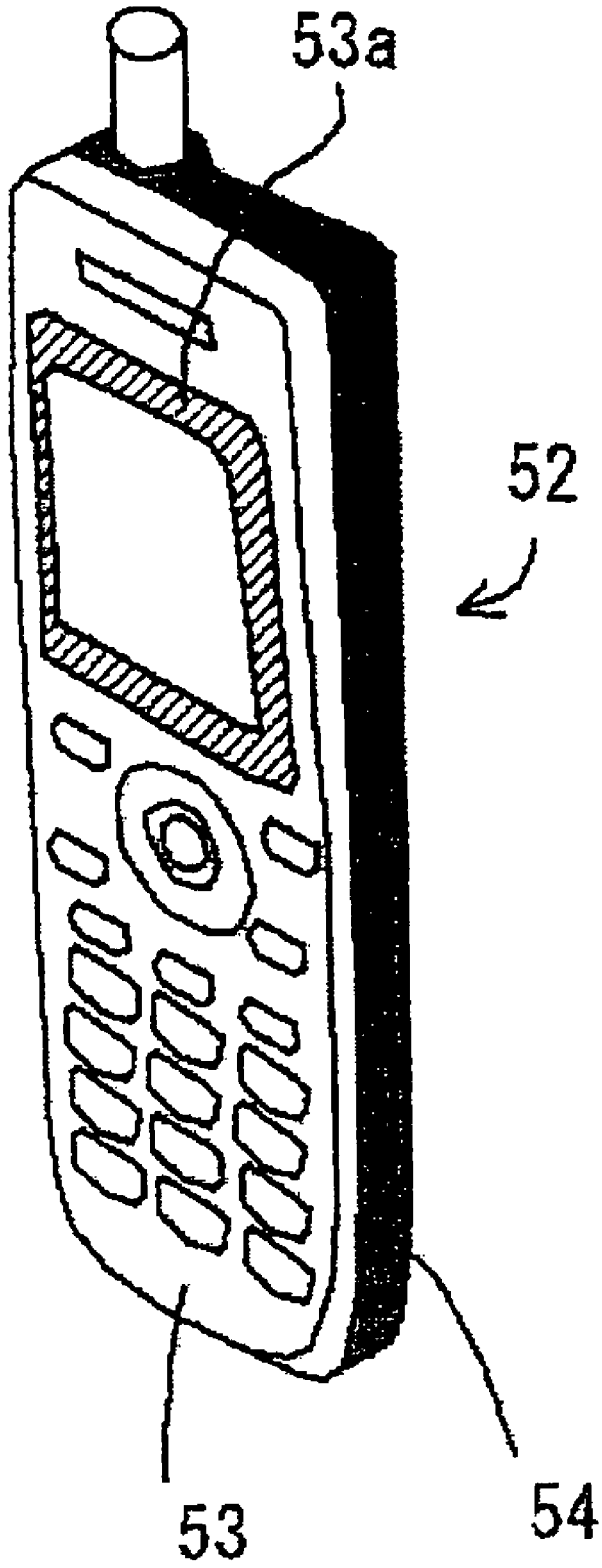
FIG. 38 is a perspective view showing an example of a housing component with an antenna in a straight-type cellular phone handset.

For example, with a straight-type cellular phone handset 52 shown by FIG. 38, a surface cover 53 and a backside cover 54 becomes the housing component, but a window cover 53*a* alone can be called the housing component.

Figure 39:
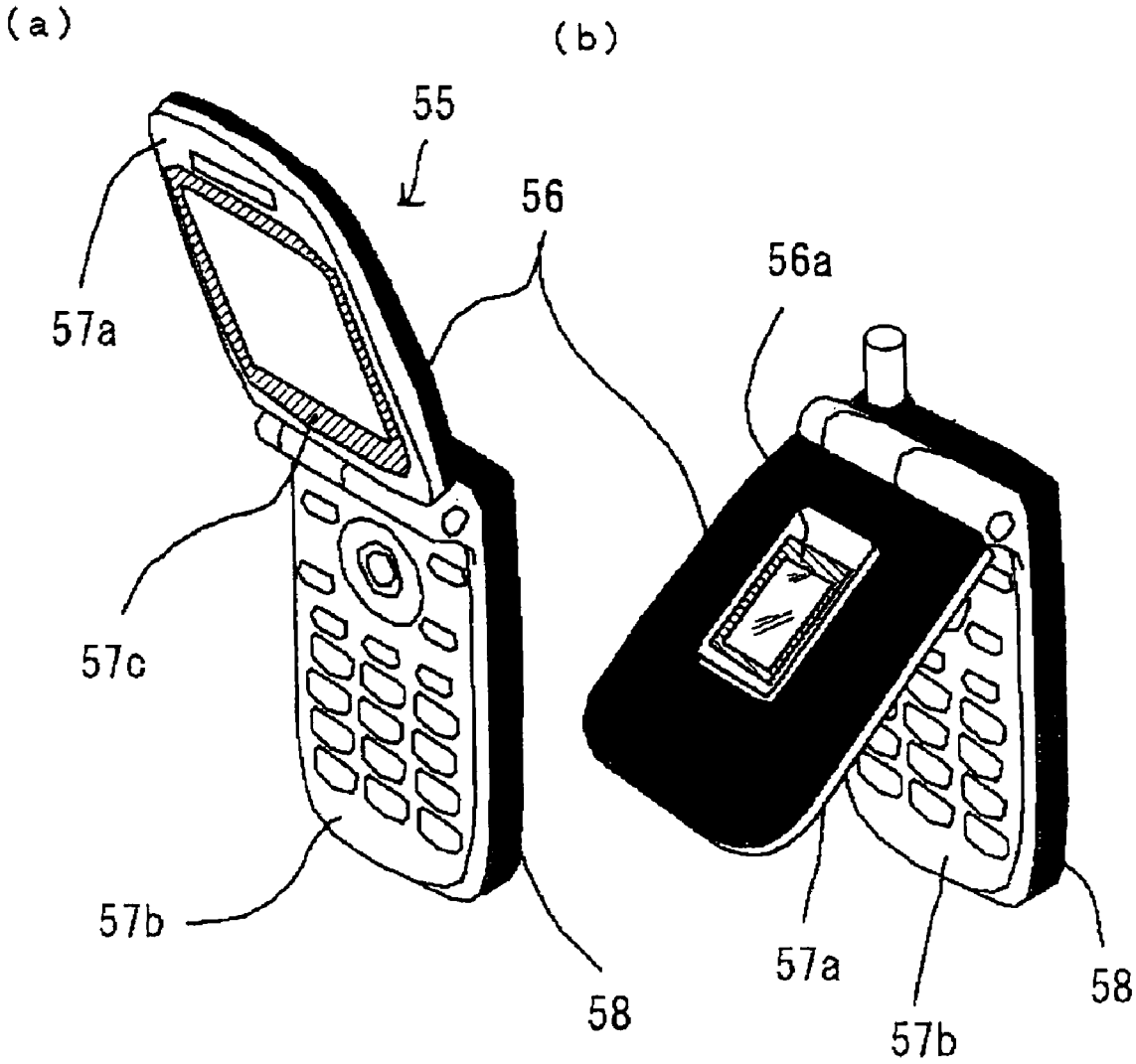
FIG. 39 shows an example of applying the housing component having an antenna to a foldable cellular phone handset, and (a) is a perspective view showing an opened state of the cellular phone while (b) is a perspective view showing a closed state thereof.

Further, in a case of a foldable cellular phone handset 55 shown by FIG. 39, each of a surface cover 56, an inner upper cover 57*a*, an inner lower cover 57*b* and a backside cover 58 becomes a housing component, but a window cover 57*c* of an inner surface side and a window cover 56*a* of a front surface side can also be called the housing component.

Figure 40:
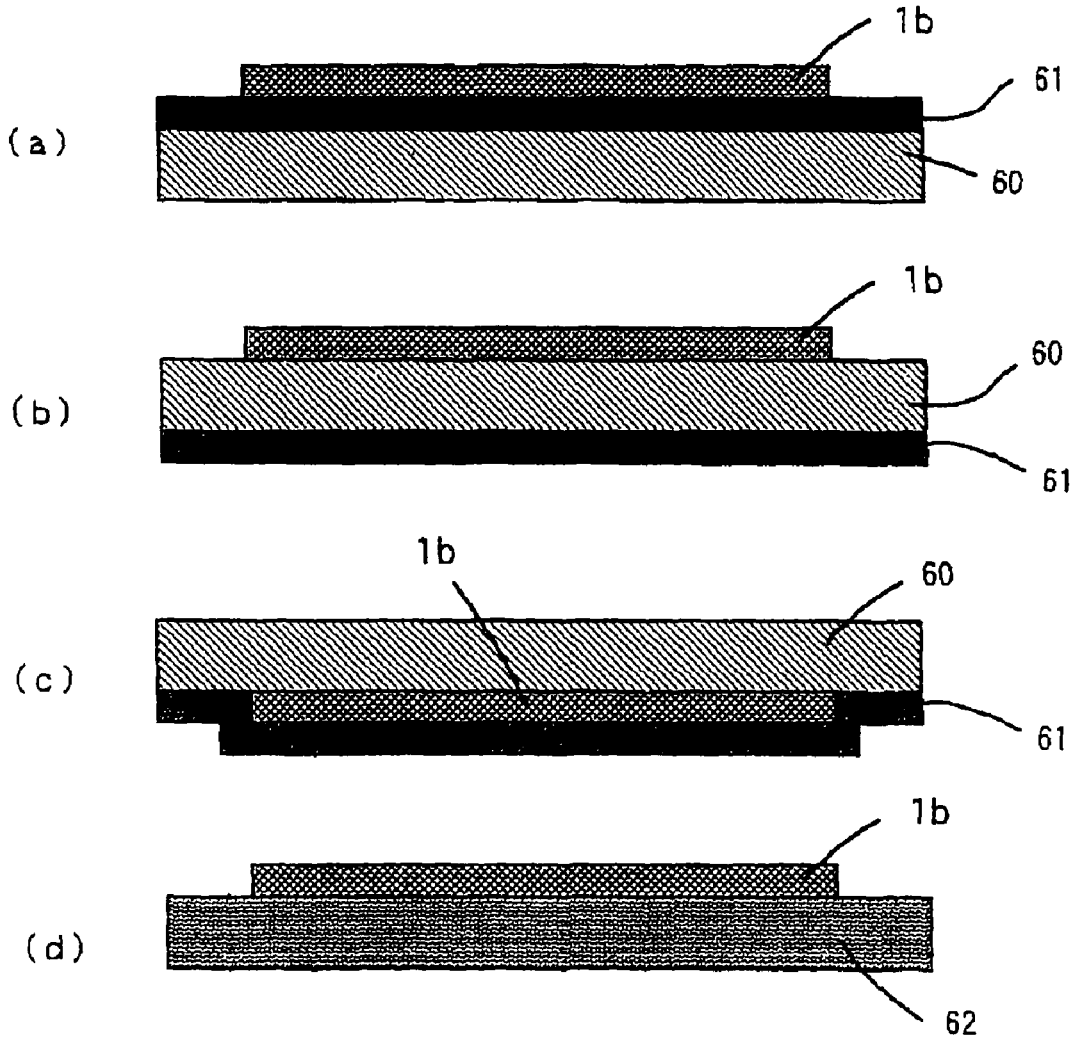
FIGS. 40(*a*) to (*d*) are schematic view illustrating an arrangement of the electrically conductive part of FIG. 37.

FIG. 40 shows a T-T cut surface of FIG. 1, which will be explained taking an example of a window cover 53*a* as a housing component.

A resin-molded plate 60 is formed in a shape of a desired housing component 50, and polycarbonate, acryl, polyethylene terephthalate, triacetyl cellulose and the like may be used as a material.

As shown in FIG. 40 (*a*), in order to provide an opaque decorative section 51*b* (refer to FIG. 37) to a resin-molded plate 60, a decorative layer 61 is to be provided on a front surface of the resin-molded plate 60 or a decorative layer 61 is provided on a backside surface of a resin-molded plate 60 as shown in FIG. 40(*b*) or (*c*).

As a material for the decorative layer 61, urethane resin, polycarbonate resin, vinyl resin, polyester resin and the like may be used. In particular, urethane-based resin is preferably used. Further, a colored ink containing a pigment or dye of a desired color may be used while using an elastomer of the urethane-based resin as a binder.

As a method for forming the decorative layer 61, a printing method such as offset printing, gravure printing, and screen printing and a coating method such as gravure coating, roll coating and comma coating may be employed.

Transfer method and a simultaneous in mold transfer method may also be used. The transfer method comprises, using a transcription material formed with transcription layer composed of a separating layer, a decorative layer, an adhesive layer and the like on a base sheet, making the transfer layer adhere to the transcription object by applying heat and pressure, followed by separating the base sheet and transcribing the transfer layer alone on a surface of the transcription object for decoration.

In contrast, a simultaneous in mold transfer method is a method comprising inserting a transcription material in a metal mold, injection-filling a cavity with a resin followed by cooling to obtain a molded resin piece, and simultaneously bonding a surface thereof with a transcription material followed by separating the base sheet, and transcribing a transfer layer on a surface of the transcription object.

In the simultaneous in mold transfer method, since adhesion of the molded resin piece is high, an adhesive layer can be omitted. Additionally, in the present invention, the base sheet may be kept without being separated, and in such a case, the separating layer may be omitted.

As a material of the base sheet, a resin sheet such as polypropylene-based resin, polyethylene-based resin, polyamide-based resin, polyester-based resin, polyacrylic resin, and polyvinyl chloride-based resin may be used.

As a material of the separating layer, in addition to a polyacrylic resin, a polyester-based resin, a polyvinyl chloride-based resin, a cellulose-based resin, a rubber-based resin, polyurethane-based resin, polyvinyl acetate-based resin and the like, a copolymer such as vinyl chloride-vinyl acetate copolymer-based resin, and ethylene-vinyl acetate copolymer-based resin may be used. If hardness is required for the separating layer, a photo-curing resin such as a ultraviolet thermosetting resin, a radiation curing resin such as an electron radiation curing resin, and a thermosetting resin may be selected.

As the adhesive layer, a thermosensitive or a pressure sensitive resin suitable as a material for the transcription object is used as necessary. For example, if the material of the transcription object is a polyacrylic resin, a polyacrylic resin may be used. If the material of the transcription object is polyphenylene oxide copolymer polystyrene-based copolymer resin, a polycarbonate-based resin, styrene polystyrene-based blended resin, polyacrylic resin, polystyrene-based resin, polyamide-based resin and the like which has an affinity with the polystyrene-based blended resin may be used. Further, if a material of the transcription object is polypropylene resin, chlorinated polyolefins resin, chlorinated ethylene-vinyl acetate copolymer resin, cyclized rubber, and coumarone-indene resin can be used.

As another means for attaching the opaque decorative section 51*b* to the resin-molded plate 60, as shown in FIG. 40(*d*), it is possible to include a colorant only within a range required in the resin-molded plate 60 to give the colored resin-molded plate 62.

Since the housing component with an antenna 50 shown in FIG. 37 is constituted as a window cover, it partially has the opaque decorative section 51*b* for the purpose of forming the transparent window section for display 51*a*, but an entire surface of the housing component with an antenna 50 may be the opaque decorative section 51*b*.

In the case where the housing component with an antenna 50 is applied to covers 53 to 58 which are other than a window cover (refer to FIGS. 38 and 39), a transparent window section 51*a* and a camera lens may be disposed, or, for other purposes, there may be a part in which an opaque decorative section 51*b* is not provided.

In FIG. 40, if an antenna pattern which is in a planar form and has a light transmission of 70% or more is formed as the transparent antenna 50*a* on a front surface side of the layer which attaches the opaque decorative section 51*b* to the resin-molded plate 60 (refer to FIGS. 40(*a*) to (*d*)), and the electrically conductive section 1*b* of the antenna pattern comprises an electrically conductive thin film of the mesh structure, and an outline of each mesh comprises an extra fine band having substantially an equal width, when looking at the opaque decorative section 51*b*, the antenna pattern is only recognized as a slight change of shading, so that the transparent antenna 50*a* does not damage a design added to the housing behind the transparent antenna 50*a*.

Additionally, in the present embodiment, since a relatively large area of the display can be used for the transparent antenna 50*a*, it can enhance receiver sensitivity and a good transmission and reception is achieved.

Further, if the housing component with an antenna 50 has the transparent window section for display 51*a* other than the opaque decorative section 51*b*, the antenna pattern can be extended up to the transparent window section 51*a* (refer to FIG. 37).

As the electrically conductive thin film, a metal thin film such as copper, nickel, aluminum, gold, and silver, or an electrically conductive resin paste film containing the these metal particulates or an electrically conductive resin paste film containing carbon particulates may be used. The electrically conductive thin film is formed into a fine mesh-shaped pattern by photo-etching or by an etching method using print resist or by a method printing an electrically conductive resin paste.

The antenna pattern has an electrically conductive section 1*c* for power supply which is electrically connected with a mesh-shaped pattern.

In the present embodiment, with respect to the electrode part 1*c*, if an antenna pattern as the electrically conductive section 1*b* is disposed on a backside of the resin-molded plate 60 as shown in FIG. 40(*c*), the antenna pattern is connected to the radio transmission section mounted in housing via a wiring.

As shown in FIGS. 40(*a*), (*b*), and (*d*), when the antenna pattern as the electrically conductive section 1*b* is disposed on a front surface side of the resin-molded plate 60 (or 62), it is connected with a radio transmission section in the housing via a through hole or a notch at the resin-molded plate 60. However, in the case that a housing component with an antenna 50 itself constitutes the window cover 53*a* and the rim portion is covered with an outer frame of another housing component with an antenna, it can be connected via an input-output terminal provided on an inner surface side of the outer frame.

The antenna pattern may be formed directly on the resin-molded plate 60, or may be formed using a transcription method or simultaneous in mold transfer method in a same manner as the formation of the decorative layer 61. In a latter case, in the present embodiment, a base sheet may remain without being separated. The antenna pattern is the same as previously shown in FIGS. 4 to 6.

As shown in FIG. 37, if the housing component with an antenna 50 has the transparent window section for display 51*a* in addition to the opaque decorative section 51*b* and the antenna pattern is extended up to the transparent window section 51*a*, the transparent antenna 50*a* needs to be prevented from interfering with a mesh pattern constituting the picture element of the display so as not to form a moire pattern.

Namely, in accordance with a size or shape of the picture element of the display, a shape of a mesh aperture, pitch, and bias angle of the antenna pattern in the transparent antenna 50*a* is adjusted. In practice, an easy and convenient way is to make a few kinds of prototypes and check a presence of the moire pattern with eyes to determine the specification.

c-2. A Case of having a Transmissive Decorative Section

Next, a first variation of the housing component with an antenna will be explained.

Figure 41:
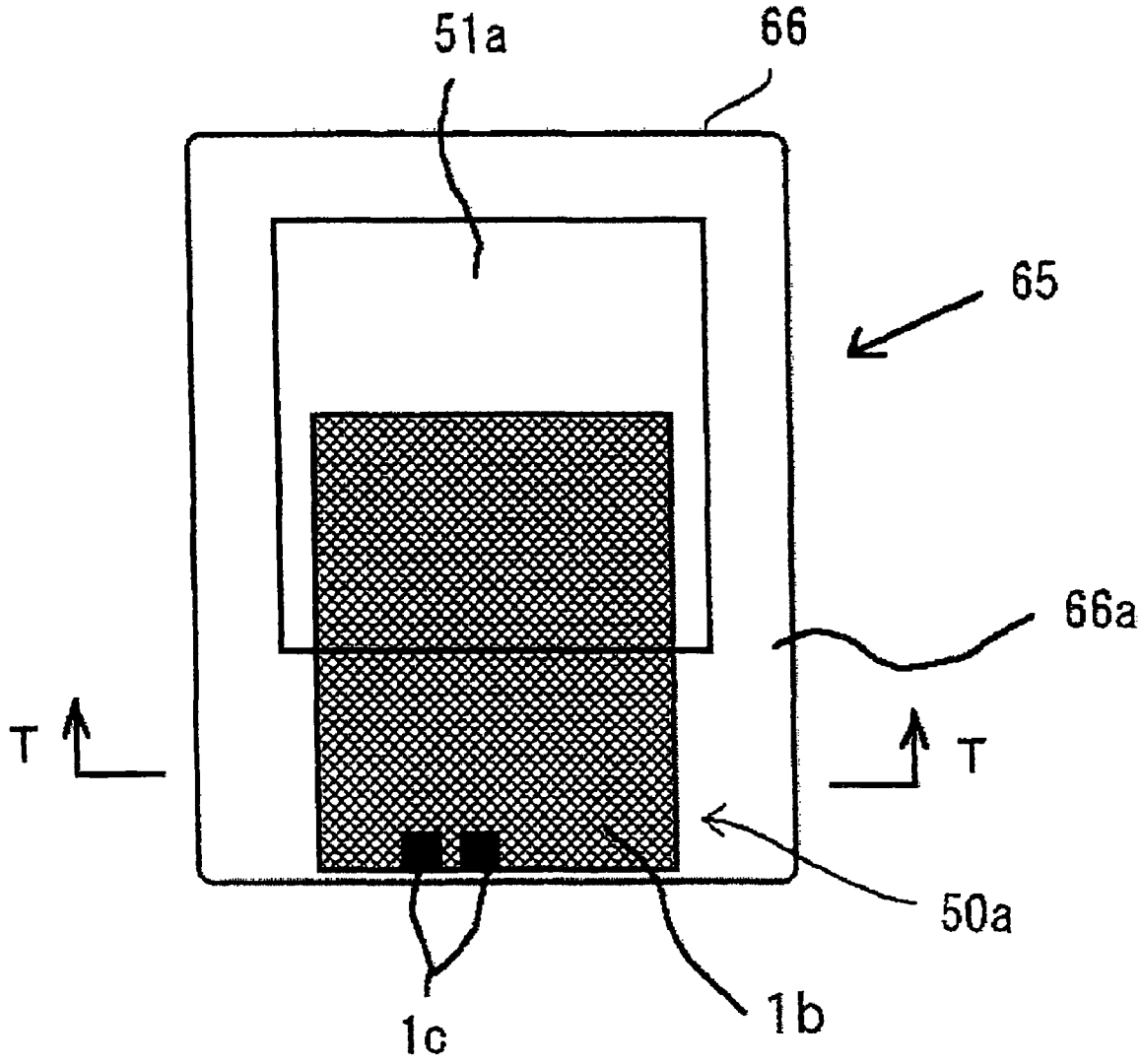
FIG. 41 is a drawing corresponding to FIG. 37 showing a variation of the housing component with an antenna according to the present invention.

FIG. 41 shows a first variation of the housing component with an antenna.

A difference of the housing component with an antenna 65 shown by FIG. 41 from the housing component with an antenna 51 in FIG. 37 is that the opaque decorative section 51*b* is changed to the transmissive decorative section 66*a*.

The housing component with an antenna 65 has a transmissive decorative section 66*a* in a part or an entire part of the resin-molded plate 66. The transmissive decorative section 66*a* causes a decorative effect by illuminating the resin-molded plate 66 from a back side thereof and an antenna pattern is formed on the transmissive decorative section 66*a* consists of the electrically conductive section lb.

Figure 42:
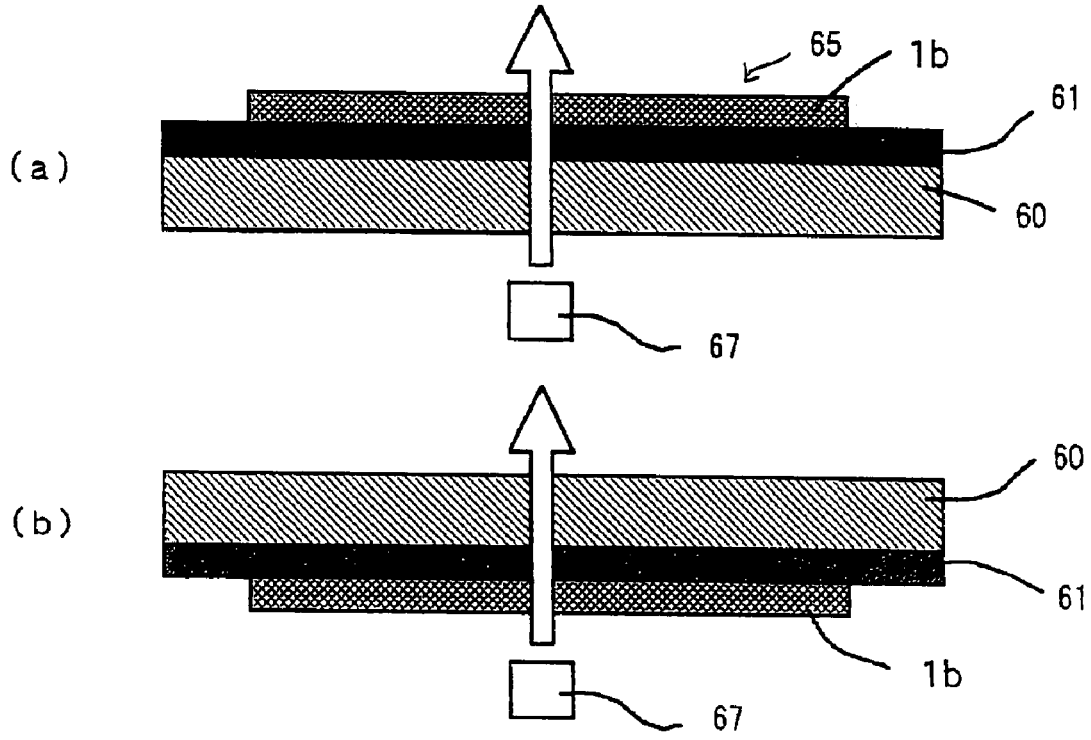
FIG. 42(*a*) and (*b*) are cross sectional views showing a relation between the electrically conductive part of FIG. 41 and a light source.

Specifically, the transmissive decorative section 66*a*, as shown in FIG. 42(*a*), emits light in various colors by illumination from the light source 67 positioned on a back side of the housing component 65 such as light-emitting diode and fluorescent light, and for example, taking an example of a cellular phone handset, the housing lights up in various colors in accordance with rhythms of ringing melody, game, and alarm which are accompanying functions of a cellular phone handset.

The transmissive decorative section 66*a* can be obtained by forming the decorative layer 61, but decoration can be done by making the light-emitting diode and the fluorescent light which are positioned on the back side be colored in red, blue, green and the like, so the decorative layer 61 is not always necessary.

However, when the light from the back side is white light, a translucent decorative layer 61*a* needs to be provided on a front surface side or a backside of the resin-molded plate 60, or colorant needs to be included to a degree that translucency in a desired range in the resin-molded plate 60 can be obtained. The resin-molded plate 60 and the decorative layer 61 corresponding to the transmissive decorative section 66*a* can be any of colored transparent, half transparent, and opaque as long as it transmits light from the back side.

In the transmissive decorative section 66*a*, a layer structure of the antenna pattern the resin-molded plate 60 or a layer structure adding the decorative layer 61 thereto, transmits light via any layer of those from the back side unlike the above embodiment; thus, as shown by FIG. 42(*b*), the housing component with an antenna 65 may be positioned upside down so as to transmit light.

For example, it is allowed to exist a part which is not decorated by illumination other than the transmissive decorative section 66*a* and the transparent window section 51*a*, such as in a case where a surrounding of the transparent window section 51*a* is rimmed with an opaque decorative section and the transmissive decorative section 66*a* is provided on the periphery of opaque decorative section.

In order to provide a part which is not decorated by illumination, a light shielding layer may be formed on a necessary part of the front surface side or the backside of the resin-molded plate 60. As the light shielding layer, for example, a decorative layer containing a colorant to a degree that it can shield light may be formed.

c-3. Case of Illuminating the Transmissive Decorative Section from a Side Thereof.

Figure 43:
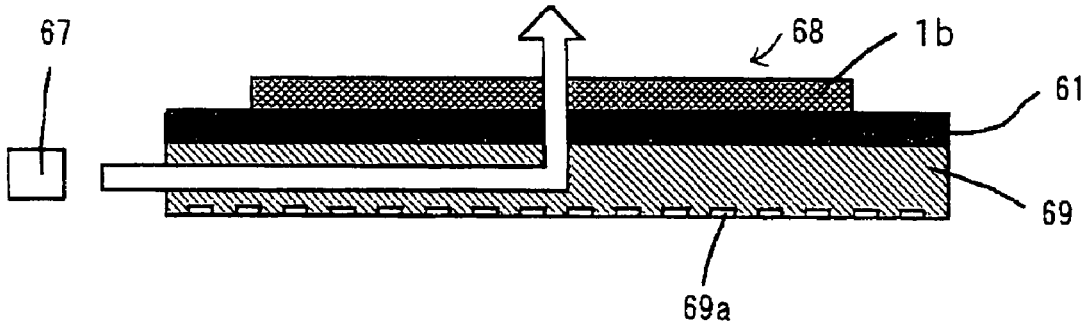
FIG. 43 is a cross sectional view showing a relation between the electrically conductive part of FIG. 41 and another light source.

Next, a second variation of the housing component will be explained with reference to FIG. 43.

The housing component 68 shown in the figure is one in which a transparent decorative layer 61 is laminated on a resin-molded plate 69, and an electrically conductive section 1*b* is formed on the decorative layer 61, and by illumination from the light source 67 positioned from a side of the housing component 68, the decorative layer 61 as a transmissive decorative section formed in a part or an entire part or an entire part on the resin-molded plate 69 has a decorative effect.

In this case, a position of forming the antenna pattern comprising the electrically conductive section 1*b* is limited to a front surface side of the resin-molded plate 69 because a method of illumination in the transmissive decorative section is different from that of the above-described first variation.

Specifically, with a second variation, since a housing component is structured so that light is allowed to enter from a side of the resin-molded plate 69, and the light is introduced to a deeper side thereof by using an internal reflection effect of the resin-molded plate 69, and the incident light is reflected on a front surface side of the housing component 68 through a light output section 69*a* such as microscopic concavity and convexity and a reflection dot of a backside of the resin-molded plate 69, and thus it is meaningless to form the transparent antenna pattern and the decorative layer 61 having permeability on a backside of the resin-molded plate 69 which is not implicated in the decoration by illumination.

In order to stabilize antenna performance and protect the antenna pattern, a front surface of the electrically conductive section 1*b* of the antenna pattern can be covered with a transparent cover layer (transparent protection film).

Example 18

After a transparent resin layer containing a plating catalyst was formed on a 100 μm-thick base sheet of a transparent polyethylene terephthalate film, and an electroless copper nickel plating was carried out, subsequently, copper electroplating were carried out to form a metal thin film. Next, by using a method of photo-etching, a mesh aperture was formed on the metal thin film (to be an electrically conductive thin film of the mesh structure) to give an antenna pattern having a light transmittance of 92%.

The electrically conductive section of the antenna pattern is a square mesh pattern as shown in FIG. 4, and an extra fine band thereof has a line width (w) of 15 μm, a pitch between lines of 400 μm and a bias angle of 30°.

Next, a decorative layer composed of any opaque pattern was formed on the part excluding the transparent window section for display and the electrode part of the antenna pattern to give an opaque decorative section.

Next, an outside thereof was cut along the antenna pattern which had been produced to be inserted into a metal mold for a surface cover (having a sub window) 53 for a foldable cellular phone handset, and a film formed with the antenna pattern was fitted so that the base sheet side adhered to a cavity-formed surface on a front surface side of the surface cover 53, followed by carrying out injection molding using a polycarbonate resin from a side of the decorative layer. In this manner, the surface cover 53 having an antenna pattern on a front surface of the molded resin material was obtained.

However, in the injection molding, a through hole was formed on a rim of the molded resin material so that the electrode part 1*c* was exposed from the through hole.

A cellular phone handset was assembled using the surface cover 53, and on the occasion, the electrode part 1*c*, exposed from the through hole of the molded resin material and a radio transmission section in the housing were connected using a wire.

Example 19

It was same as Example 18 except that a light transmittance of the antenna pattern was 89%, a shape of the mesh aperture of the electrically conductive section formed a regular hexagon lattice pattern of 500 μm on a side, and a line width of the extra fine metal band was 25 μm.

Example 20

In Example 18, the step after forming the antenna pattern was changed to a following.

Namely, a decorative layer composed of a light blocking pattern was provided on a rim section of the transparent window section for display in a frame-like form, a translucent decorative layer was formed on a transparent window section, a rim section thereof and a part of an antenna pattern excluding the electrode part to give a transmissive decorative section.

When a cellular phone handset was assembled using the surface cover 53, red-color, blue-color and green-color light-emitting diodes were positioned on a backside of the transmissive decorative section of the surface cover 53. It was same as in Example 18 except for these changes.

Example 21

In Example 19, microscopic concavity and convexity are provided on a back side of the resin-molded plate as a light output section, and red-color, blue-color and green-color light-emitting diodes were positioned on a side surface of the molded resin material instead of the back side of the transmissive decorative section of the surface cover 53. It was same as in Example 19 except for these changes.

In all the cellular phone handsets using the housing component with an antenna shown by Examples 18 to 21, a presence of an antenna pattern was not substantially recognized, and did not damage a design provided on the housing. The reception condition of radio waves was also clear.

The housing component with an antenna is formed into a mesh structure in which an electrically conductive section of an antenna pattern has a number of apertures, and an outline of each mesh comprises extra fine bands, so that when an opaque decorative section and a transmissive decorative section are looked at, the antenna pattern is recognized only as a slight change of shading, and the antenna pattern does not damage a design provided on a housing. Further, since a relatively large area on the display can be used as an area for positioning the antenna, receiver sensitivity can be improve and good transmission and reception is possible.

A transparent antenna of the present invention can be used for receiving terrestrial broadcast and satellite broadcast by attaching the antenna to a front surface of a display of a mobile device, such as a television monitor and a mobile phone.

The invention claimed is:

1. A transparent antenna for a display, said antenna comprising:

an electrically isolated transparent substrate having a surface, said transparent substrate being in planar form so as to form a sheet; and an antenna pattern formed on said surface of said transparent substrate, and having an electrically conductive section, said electrically conductive section of said antenna pattern including an electrically conductive thin film formed from a first mesh structure and a second mesh structure, said first and second mesh structures being formed from metal wires, each of said metal wires in said first mesh structure being substantially equal in width to each other of said metal wires in said first mesh structure, and a light transmittance of said first mesh structure being 70% or higher, wherein said first mesh structure includes continuous planar meshes on a plane, each of said continuous planar meshes having the same shape and size as each other of said continuous planar meshes, and said second mesh structure forms a distinguishing pattern that distinguishes a part of said antenna pattern, and includes a plurality of meshes, said distinguishing pattern being formed by a linear pattern being disposed on said plurality of meshes in said second mesh structure or bands being disposed on said plurality of meshes in said second mesh structure so as to outline said metal wires in said second mesh structure, the distinguishing pattern decreasing the light quantity passing through said plurality of meshes in said second mesh structure, such that the light quantity passing through said plurality of meshes in said second mesh structure is less than the light quantity passing through said continuous planar meshes in said first mesh structure.

2. The transparent antenna for a display according to claim 1, wherein the transparent antenna is capable of being laminated on a display having a picture element, and the first mesh structure has a mesh pitch and a bias angle that do not form moire fringes with a mesh pattern.

3. The transparent antenna for a display according to claim 1, wherein said bands disposed on said metal wires in said plurality of meshes in said second mesh structure enable said metal wires in said plurality of meshes in said second mesh structure to have a width larger than the width of said metal wires in said first mesh structure.

4. The transparent antenna for a display according to claim 1, wherein said second mesh structure forming said distinguishing pattern is formed by shifting said second mesh structure relative to said first mesh structure within a range not exceeding the size of a single mesh and by superposing said second mesh structure on said antenna pattern.

5. The transparent antenna for a display according to claim 1, wherein said distinguishing pattern is formed continuously or intermittently on said antenna pattern to thereby form letters and designs on said antenna pattern.

6. A transparent antenna for a display, said antenna comprising:

an electrically isolated transparent substrate having a surface, said transparent substrate being in planar form so as to form a sheet; and an antenna pattern disposed on said surface of said transparent substrate, and having an electrically conductive section, said electrically conductive section of said antenna pattern including an electrically conductive thin film formed from a mesh structure, the mesh structure being formed from metal wires, each of said metal wires in said mesh structure being substantially equal in width to each other of said metal wires in said mesh structure, and a light transmittance of said antenna pattern being 70% or higher, wherein said mesh structure includes continuous planar meshes on a plane forming said antenna pattern and a gradation section forming an antenna pattern non-formation section on said transparent substrate adjacent said antenna pattern so as to form a boundary region between said antenna pattern and said antenna pattern non-formation section, said gradation section decreasing a luminance difference between said antenna pattern and said antenna pattern non-formation section in said boundary region of said antenna pattern and said antenna pattern non-formation section.

7. The transparent antenna for a display according to claim 6, wherein said gradation section is formed by partially eliminating mesh outlines or coarsening meshes of said continuous planar meshes in said boundary region.

8. The transparent antenna for a display according to claim 6, wherein said gradation section is formed by lengthening eliminated mesh outlines of said continuous planar meshes or lengthening an aperture width of said meshes in a step by step manner from said antenna pattern side to said antenna pattern non-formation section side.

9. The transparent antenna for a display according to claim 6, wherein said mesh structure includes a plurality of vertical direction electrically conductive wires and a plurality of transverse direction electrically conductive wires arranged in a lattice state and said gradation section is formed by eliminating a part of at least one of said vertical direction electrically conductive wires and said transverse direction electrically conductive wires or widening intervals of one of said plurality of vertical direction electrically conductive wires and said plurality of transverse direction electrically conductive wires from said antenna pattern to said antenna pattern non-formation section.

10. The transparent antenna for a display according to claim 6, wherein said antenna pattern is formed in a continuous band state by forming slits in a part of said mesh structure and the width of each of said slits is configured not to exceed the maximum size of the mesh size.

11. The transparent antenna for a display according to claim 10, wherein a meandering shape is formed in said antenna pattern by forming said slits with a prescribed length alternately from different directions in said mesh structure.

12. The transparent antenna for a display according to claim 10, wherein said slits form a spiral toward the center of said mesh structure.

13. The transparent antenna for a display according to claim 10, wherein the maximum size of each of said continuous planar meshes is 1 mm.

14. The transparent antenna for a display according to claim claim 6, wherein the shape of each of said continuous planar meshes is a geometric design.

15. The transparent antenna for a display according to claim 6, wherein a width of each metal wire of the metal wires is 30 μm or less.

16. The transparent antenna for a display according to claim claim 6, wherein said metal wires are copper or a copper alloy.

17. The transparent antenna for a display according to claim 6, wherein a transparent protection film is formed on the surface of said antenna pattern.

18. The transparent antenna for a display according to claim 6, wherein an electrode for electric power supply is installed in a part of said electrically conductive section and a though hole part corresponding to the electrode is formed in a transparent protection film to expose said electrode.

19. The transparent antenna for a display according to claim claim 6, wherein the surface of each metal wire of said metal wires is subjected to low-reflection treatment.

20. The transparent antenna for a display according to claim claim 6, wherein a transparent pressure sensitive adhesive layer is disposed on a surface of said transparent substrate, said surface on which said transparent pressure sensitive adhesive layer is disposed being opposite said surface on which said antenna pattern is disposed.

21. A translucent member with an antenna obtained by embedding a transparent antenna for a display according to claim 6, equipped with an electrode for electric power supply in a part of said electrically conductive section, in two translucent plate materials in a state in which said electrode projects out of one of the translucent plate materials.

22. The translucent member for a display with an antenna according to claim 21, wherein the transparent antenna for a display and the translucent plate materials are integrated by injection molding.

23. A housing component, comprising:

a molded resin material as a main layer and an opaque decorative section in a part or an entire part of said main layer, wherein a front surface side of a layer providing a decoration of said opaque decorative section has a transparent antenna for a display according to claim 6, and said transparent antenna has an electrode for power supply.

24. The housing component according to claim 23, further comprising a transparent window section for display other than a decorative section, and said transparent antenna extends up to said transparent window section.

25. The housing component according to claim 24, wherein said housing component is combined with a window cover.

26. The housing component according to claim 24, wherein said transparent extending up to said transparent window section is set in a mesh shape, a mesh pitch, and a bias angle which do not form moire fringes with a mesh pattern.

27. The housing component according to claim 23, wherein a part of said electrically conductive section of said transparent antenna is combined with said electrode for power supply.

28. A housing component, comprising:

a molded resin material as a main layer and a transmissive decorative section giving a decorative effect by illumination from a back side in a part or an entire part of said main layer, wherein said transmissive decorative section has a transparent antenna for a display according to claim 6, and said transparent antenna has an electrode for power supply.

29. The housing component according to claim 28, further comprising a transparent window section for display other than a decorative section, and said transparent antenna extends up to said transparent window section.

30. The housing component according to claim 28, wherein a part of said electrically conductive section of said transparent antenna is combined with said electrode for power supply.

31. A housing component, comprising:

a molded resin material as a main layer and a transmissive decorative section giving a decorative effect by illumination from a side surface in a part or an entire part of said main layer, wherein a front surface side of the molded resin material of said transmissive decorative section of said molded resin material has a transparent antenna for a display according to claim 6, and said transparent antenna has an electrode for power supply.

32. The housing component according to claim 31, further comprising a transparent window section for display other than a decorative section, and said transparent antenna extends up to said transparent window section.

33. The housing component according to claim 31, wherein a part of said electrically conductive section of said transparent antenna is combined with said electrode for power supply.

* * * * *